US010439368B2

(12) United States Patent
Nishimura et al.

(10) Patent No.: US 10,439,368 B2
(45) Date of Patent: Oct. 8, 2019

(54) PRODUCTION METHOD OF SPARK PLUG

(71) Applicant: NGK SPARK PLUG CO., LTD., Nagoya-shi, Aichi (JP)

(72) Inventors: Kota Nishimura, Konan (JP); Norihide Kachikawa, Seto (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/142,069

(22) Filed: Sep. 26, 2018

(65) Prior Publication Data

US 2019/0103732 A1 Apr. 4, 2019

(30) Foreign Application Priority Data

Oct. 3, 2017 (JP) ..... 2017-193327

(51) Int. Cl.
*H01T 21/02* (2006.01)
*H01T 13/20* (2006.01)
*H01T 21/06* (2006.01)

(52) U.S. Cl.
CPC ..... *H01T 21/02* (2013.01); *H01T 13/20* (2013.01); *H01T 21/06* (2013.01)

(58) Field of Classification Search
CPC ..... H01T 21/02; H01T 21/06; H01T 21/00; H01T 13/20; H01T 13/58; H01T 13/60; B24C 1/04; F02P 17/12; G05B 19/4097; G05B 2219/35134
See application file for complete search history.

(56) References Cited

U.S. PATENT DOCUMENTS 5,741,963 A * 4/1998 Nakatani ..... H01T 21/06 445/7
2002/0034915 A1* 3/2002 Nakatani ..... H01T 21/06 445/2
2002/0102898 A1* 8/2002 Ito ..... H01T 21/02 445/4
2002/0142696 A1* 10/2002 Ito ..... H01T 21/02 445/3
2004/0029480 A1* 2/2004 Fujita ..... H01T 21/02 445/7

(Continued)

FOREIGN PATENT DOCUMENTS

JP H09-219273 A 8/1997

*Primary Examiner* — Joseph L Williams
*Assistant Examiner* — Jose M Diaz
(74) *Attorney, Agent, or Firm* — Kusner & Jaffe

(57) ABSTRACT

Standard image data representing standard image including image of slit of a standard device is produced by photographing the standard device including the slit which includes a standard slit segment having a predetermined width. A width of the standard slit segment in the standard image is determined by analyzing the standard image data. Gap image data representing a gap image which is an image including an image of a discharge gap of a spark plug is produced by photographing the spark plug. A distance of the discharge gap in the gap image is determined by analyzing the gap image data. By using the distance of the discharge gap in the gap image and the width of the standard slit segment in the standard image, it is determined whether an actual distance of the discharge gap is within a predetermined allowable range or not.

8 Claims, 11 Drawing Sheets

(56) References Cited

U.S. PATENT DOCUMENTS

| | | | | |
|---|---|---|---|---|
| 2004/0067712 | A1* | 4/2004 | Hanai | H01T 21/06<br>445/4 |
| 2004/0078972 | A1* | 4/2004 | Hanai | H01T 21/02<br>29/857 |
| 2005/0039332 | A1* | 2/2005 | Oda | H01T 21/02<br>29/882 |

* cited by examiner

PRODUCTION METHOD OF SPARK PLUG

FIELD OF THE INVENTION

The present invention relates to technique for producing or inspecting a spark plug.

The spark plug is widely used for ignition in a device for combustion of fuel (an internal combustion engine, for example). Typically, a spark plug includes an insulating member, a center electrode supported at a forward end of the insulating member, an outer metal member (or metal shell) surrounding the insulating member, and a ground electrode connected with the outer metal member and arranged to confront the center electrode and thereby to form a discharge gap with the center electrode.

JP H09-219273A discloses one example of the spark plug.

SUMMARY OF THE INVENTION

For improvement in performance of the device such as the internal combustion engine (increase of the output, improvement in fuel consumption, for example), the discharge across the discharge gap is important. For adequate discharge, the allowable range of the distance of the discharge gap tends to become smaller. However, it is not easy to improve the accuracy in determining whether the distance of the discharge gap is within the allowable or permissible range or not.

In this specification, there is disclosed technique for improving the accuracy in determining whether the distance of the discharge gap is within the allowable range or not. As examples, following application examples are disclosed.

APPLICATION EXAMPLE 1

In accordance with a first aspect of the present invention, there is provided a spark plug production method of producing a spark plug which comprises an insulating member, a center electrode including a portion disposed at a forward end of the insulating member, a tubular outer metal member or metal shell surrounding the insulating member or disposed around the insulating member, and a ground electrode connected with the outer metal member and arranged to confront the center electrode to form a discharge gap, the spark plug production method comprising:

producing standard image data representing a standard image by capturing an image of a standard device including a slit forming section forming a slit which includes a standard slit segment having a predetermined width, with an image capturing device, the standard image being an image including an image of the slit of the standard device;

determining a width of the standard slit segment of the slit in the standard image by analyzing the standard image data;

producing gap image data representing a gap image which is an image including an image of the discharge gap, by capturing an image of the spark plug with the image capturing device;

determining a distance of the discharge gap in the gap image, by analyzing the gap image data; and determining whether an actual distance of the discharge gap is within a predetermined allowable range or not, by using the distance of the discharge gap determined in the gap image and the width of the standard slit segment determined in the standard image.

With this configuration using the distance of the discharge gap determined in the gap image and the width of the standard slit segment determined in the standard image for the judgment as to whether the distance of the discharge gap is within the predetermined allowable range or not, it is possible to improve the accuracy in the judgment.

APPLICATION EXAMPLE 2

In accordance with a second aspect of the present invention, there is provided a spark plug production method as recited in the application example 1, wherein the slit forming section includes a portion defining a first slit end which is one end of the slit and which is open.

With the slit extending from a second slit end to the first slit end which is not closed but open, the slit forming section of the standard device is shaped so that the shape of the slit forming section resembles the shape of the portion defining the spark gap in the spark plug in which the interspace between the ground electrode and the center electrode is open at one end. Consequently, it is possible to decrease the difference in the conditions for producing the standard image and the gap image, and hence it is possible to improve the accuracy in the judgment as to whether the distance of the discharge gap is within the predetermined allowable range.

APPLICATION EXAMPLE 3

In accordance with a third aspect of the present invention, there is provided a spark plug production method as recited in the application example 2, wherein the slit forming section includes a portion defining a wide slit segment which has a width greater than the width of the standard slit segment and which is located so that the standard slit segment is located between the first slit end and the wide slit segment.

With this configuration, the slit includes the wide slit segment wider than the standard slit segment, like the interspace which is formed between the ground electrode and the center electrode of the spark plug and which includes a wide space behind the discharge gap on the side opposite to the open end of the interspace. Therefore, the shape of the slit forming section resembles the shape of the portion defining the spark gap in the spark plug. Consequently, it is possible to decrease the difference in the conditions for producing the standard image and the gap image, and hence it is possible to improve the accuracy in the judgment as to whether the distance of the discharge gap is within the predetermined allowable range. The slit may be so formed that the standard slit segment extends from the first slit end to the wide slit segment.

APPLICATION EXAMPLE 4

In accordance with a fourth aspect of the present invention, there is provided a spark plug production method as recited in the application example 2 or 3, wherein the slit forming section includes a portion defining a second slit end which is closed and defined by a straight edge extending straight in a direction perpendicular to a direction in which the standard slit segment extends.

With this configuration, the straight edge can be used for adjusting the orientation of the standard device. Therefore, it is possible to improve the accuracy in the judgment as to whether the distance of the discharge gap is within the predetermined allowable range.

APPLICATION EXAMPLE 5

In accordance with a fifth aspect of the present invention, there is provided a spark plug production method as recited in one of the application examples 1 to 4, wherein the slit forming section includes a portion defining one of a circular arc and a part of a regular polygon, and a position of a center of one of the circular arc and the regular polygon in a direction perpendicular to a direction in which the standard slit segment extends is located in a range of the width of the standard slit segment.

With this configuration, the portion forming the circular arc or regular polygon can be used for positioning device or devices for the image capture. Therefore, it is possible to improve the accuracy in the judgment as to whether the distance of the discharge gap is within the predetermined allowable range. For example, the standard slit segment is bounded between a first straight slit edge and a second straight slit edge both of which extends in a predetermined slit longitudinal direction, the position of the center of the circular arc or the polygon in a slit width or widthwise direction perpendicular to the slit longitudinal direction is located between the positions of the first and second slit edges in the slit widthwise direction perpendicular to the slit longitudinal direction.

APPLICATION EXAMPLE 6

In accordance with a sixth aspect of the present invention, there is provided a spark plug production method as recited in one of the application examples 1 to 5, wherein the standard device includes first and second portions arranged in a predetermined direction so that the first portion is located between the slit forming section and the second portion, the second portion projects outwards beyond the first portion in a direction perpendicular to the predetermined direction, and the image of the standard device is captured with the image capturing device in a state in which a surface of the second portion of the standard device facing toward the slit forming section abuts on a predetermined portion of the jig set at a predetermined position relative to the image capturing device.

With this configuration, it is possible to set the standard device at a correct position relative to the image capturing device and reduce undesired shift in the position of the standard device. Therefore, it is possible to determine the width of the standard slit segment in the standard image, and hence to improve the accuracy in the judgment as to whether the distance of the discharge gap is within the predetermined allowable range.

APPLICATION EXAMPLE 7

In accordance with a seventh aspect of the present invention, there is provided a spark plug production method as recited in the application example 6, wherein the image of the spark plug is captured with the image capturing device in a state in which a predetermined outside surface of the outer metal member facing toward the discharge gap abuts on the predetermined portion of the jig.

With this configuration, it is possible to set the spark plug at a correct position relative to the image capturing device and reduce undesired shift in the position of the spark plug. Therefore, it is possible to determine the distance of the discharge gap in the gap image, and hence to improve the accuracy in the judgment as to whether the distance of the discharge gap is within the predetermined allowable range.

The technique disclosed in this specification can be realized in various modes. For example, the technique can be realized in a mode of an inspection method of a spark plug, a mode of a production method of a spark plug, and a mode of a spark plug produced by the production method.

DETAILED DESCRIPTION OF THE INVENTION

A. First Embodiment

Figure 1:
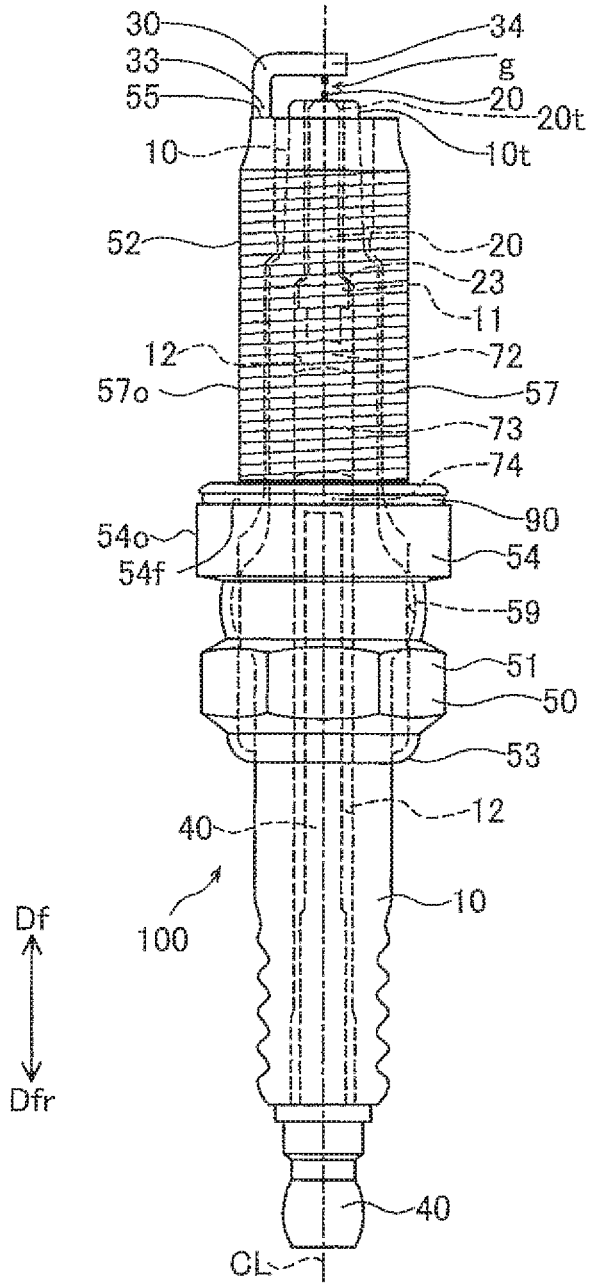
FIG. 1 is a schematic view of a spark plug 100 according to an embodiment of the present invention.

FIG. 1 is a schematic view of a spark plug 100 in one practical example according to an embodiment of the present invention. FIG. 1 shows a center line CL of spark plug 100 (also referred to as "axial line CL") and the appearance of spark plug 100. Hereinafter, a direction parallel to the center line CL is referred to as "direction of axial line CL", or simply "axial direction" or "front and rear direction" or "plug longitudinal direction". A radial direction in a circle around axial line CL at the center is referred to as "radial direction". The radial direction is a direction perpendicular to axial line CL. A direction around the circumference of a circle around axial line CL at the center is referred to as "circumferential direction". An upward direction as viewed in FIG. 1 is a direction parallel to center axis CL. This upward direction is referred to as forward direction Df, or front direction Df. A downward direction in FIG. 1 which is also parallel to center axis CL is referred to as rearward direction Dfr or rear direction Dfr. The forward direction Df is a direction extending from a later-mentioned terminal metal member 40 toward a later-mentioned center electrode 20. A side in the forward direction Df in FIG. 1 is referred to as a forward or front side of spark plug 100 or forward direction Df side. A side in the rearward direction Dfr in FIG. 1 is referred to as a rearward or rear side of spark plug 100 or rearward Dfr side.

In FIG. 1, the external appearance of spark plug 100 is shown by solid line, and the structure of spark plug 100 in a section containing the axial line CL is schematically shown by broken line. The spark plug 100 includes an insulating member 10, a center electrode 20, an outer metal member 50 which is a metal shell or main metal member 50 in this example, and a ground electrode 30. The insulating member or insulator 10 is a tubular member having a through hole 12 extending along the axial line CL. The center electrode 20 is held and supported by a forward end portion of insulating member 10 at the forward end of the through hole 12. The terminal metal member 40 is held and supported by a rearward portion of insulating member 10 at the rearward end of through hole 12. The outer metal member or metal shell 50 is a tubular member fixed around the insulating member 10. The ground electrode 30 extends from a first end joined to a forward end surface 55 of the outer metal member 50 to a second end located to confront the center electrode 20 across a gap g. Between the center electrode 20 and the terminal member 40 in the through hole 12 of insulating member 10, there is provided a member electrically connecting the center electrode 20 and terminal member 40. (In the illustrated example, this member includes a resistor 73, a conductive seal 72 connecting the center electrode 20 with the resistor 73, and a conductive seal 74 connecting the resistor 73 with terminal member 40.)

The center electrode 20 is made of metallic material, and disposed in the forward end portion of insulating member 10 defining the forward end of through hole 12 on the forward side. In this practical example, the center electrode 20 is a rod-shaped member extending along the axial line CL of spark plug 100. The forward end of center electrode 20 projects in the forward direction Df from the forward end of through hole 12 of insulating member 10. A portion 20*t* of the center electrode 20 on the rearward side is disposed in the through hole 12. Thus, center electrode 20 includes a portion (at least part of portion 20*t*) disposed at a forward portion 10*t* of insulating member 10. The forward portion 10*t* includes the forward end of insulating member and a portion extending from the forward end in the rearward direction Dfr.

As structure for fixing the center electrode 20 to insulating member 10, it is possible to employ various structures. In this practical example, the through hole 12 of insulating member 10 is formed with a reduced inside diameter segment 11 having an inside diameter made smaller gradually in the forward direction Df. On the other hand, the center electrode 20 is formed with a reduced outside diameter segment 23 having an outside diameter made smaller gradually in the forward direction Df. The reduced outside diameter segment 23 of center electrode 20 is fit and supported in the reduced inside diameter segment 11 of insulating member 10.

The ground electrode 30 is made of metallic material and fixed to the outer metal member or metal shell 50. In this practical example, ground electrode 30 is a rod-shaped member. Ground electrode 30 extends from a first end 33 fixed to the outer metal member 50, in the forward direction, bends toward the center axis CL, and further extends in the radial inward direction toward the center axis CL, to a second end 34. The second end 34 of ground electrode 30 has a rear side facing in the rearward direction Dfr, toward the center electrode 20 and thereby forming a gap g between the ground electrode 30 and center electrode 20.

Center electrode 20 and ground electrode 30 are made of material resistant to oxidation (such as nickel and nickel alloys or alloys including nickel as main component). Each of center electrode 20 and ground electrode 30 includes a tip made of material resistant to spark (for example, noble metal such as iridium (Jr) and platinum (Pt) and alloys including noble metal). The gap g is formed between the tip of center electrode 20 and the tip of ground electrode 30. However, it is optional to omit at least one of the tips of center and ground electrodes 20 and 30.

The terminal member 40 is a rod-shaped member extending in parallel to the axial line CL. Terminal member 40 is made of conductive material (metallic material including iron as main component, for example). The terminal member 40 extends in the rearward direction Dfr from a front portion to a rear portion. The front portion of terminal member 40 is inserted in the through hole 12 of insulating member 10. The rear portion of terminal member 40 on the rearward direction Dfr side projects outwards from the through hole 12 of insulating member 10, in the rearward direction Dfr.

The outer metal member or metal shell 50 is a tubular member including a through hole 59 extending along the axial line CL. The insulating member 10 is inserted in the through hole 59 of outer metal member 50, and the outer metal member 50 is fixed to the outside circumference of insulating member 10. The outer metal member 50 is made of a conductive material (metallic material such as carbon steel including iron as main component, for example). A front portion of insulating member 10 is exposed from the through hole 59 on the forward direction Df side. A rear portion of the insulating member 10 is exposed outsides from the through hole 59 of outer member 50 on the rearward direction Dfr side.

The outer metal member 50 includes a tool engagement portion 51 and a forward trunk portion 52. The tool engagement portion 51 is adapted to engage with a wrench (not shown) for spark plugs. The forward trunk portion 52 includes the forward end surface 55, and an outside circumferential surface formed with a threaded portion 57 adapted to be screwed into a mount hole of an internal combustion engine (gasoline engine, for example). The threaded portion 57 is a portion formed with an external or male screw thread of helical thread ridge and thread groove (not shown). The threaded portion 57 extends in the direction of axial line CL.

A flange-shaped middle trunk portion 54 is formed between the tool engagement portion 57 and forward trunk portion 52 of outer metal member 50. The middle trunk portion 54 expands radially outwards in the shape of outward flange. Middle trunk portion 54 includes a forward shoulder surface 54*f* facing in the forward direction Df and serving as a seat surface forming a seal with a mount portion of the internal combustion engine. The mount portion (a cylinder head, for example) is a portion in which the mount hole is formed.

An annular gasket 90 is disposed between the threaded portion 57 of forward trunk portion 52 and the seat surface 54*f* of middle trunk portion 54. For example, gasket 90 is formed by bending a metallic sheet member. In the assembled state in which the spark plug 100 is attached to the internal combustion engine, this gasket 90 is crushed and deformed. The thus-deformed gasket 90 seals the clearance between the seat surface 54*f* of middle trunk portion 54 of spark plug 100 and the mount portion (such as the cylinder or engine head), and thereby prevents leakage of combustion gases. It is optional to omit the gasket 90. In this case, the seat surface 54*f* of middle trunk portion 54 of spark plug 100 directly contacts with the mount portion of the internal combustion engine and thereby seals the clearance between the seat surface 54*f* and the mount portion of the internal combustion engine.

As the construction of spark plug 100, it is possible to employ any of the known constructions. The construction of spark plug 100 is not limited to the illustrated example.

Moreover, as the method of assembling the spark plug 100, it is possible to employ any of the known methods. For example, to fix the outer metal member 50 to insulating member 10, the rear end portion 53 of outer metal member 50 is caulked or deformed for fixing.

Figure 2:
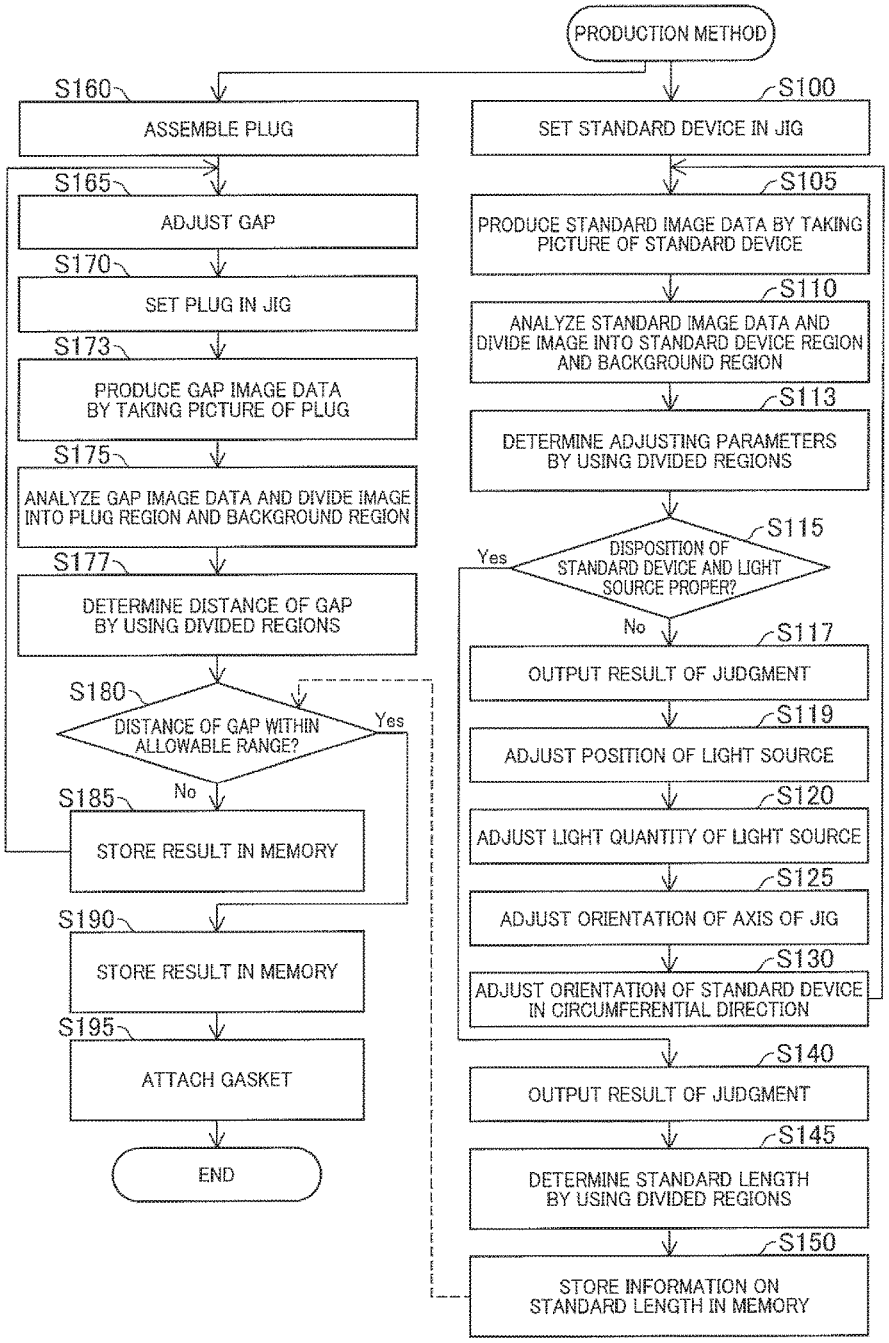
FIG. 2 is a flowchart showing an example of a production method of the spark plug 100.

FIG. 2 is a flowchart showing one practical example of the production method of the spark plug 100. In this embodiment, the judgement to decide whether the distance of the gap g is within an allowable range or not, is performed by using image data obtained by recording images of a standard or reference device and image data obtained by recording images of the spark plug 100 as explained later.

Figure 3:
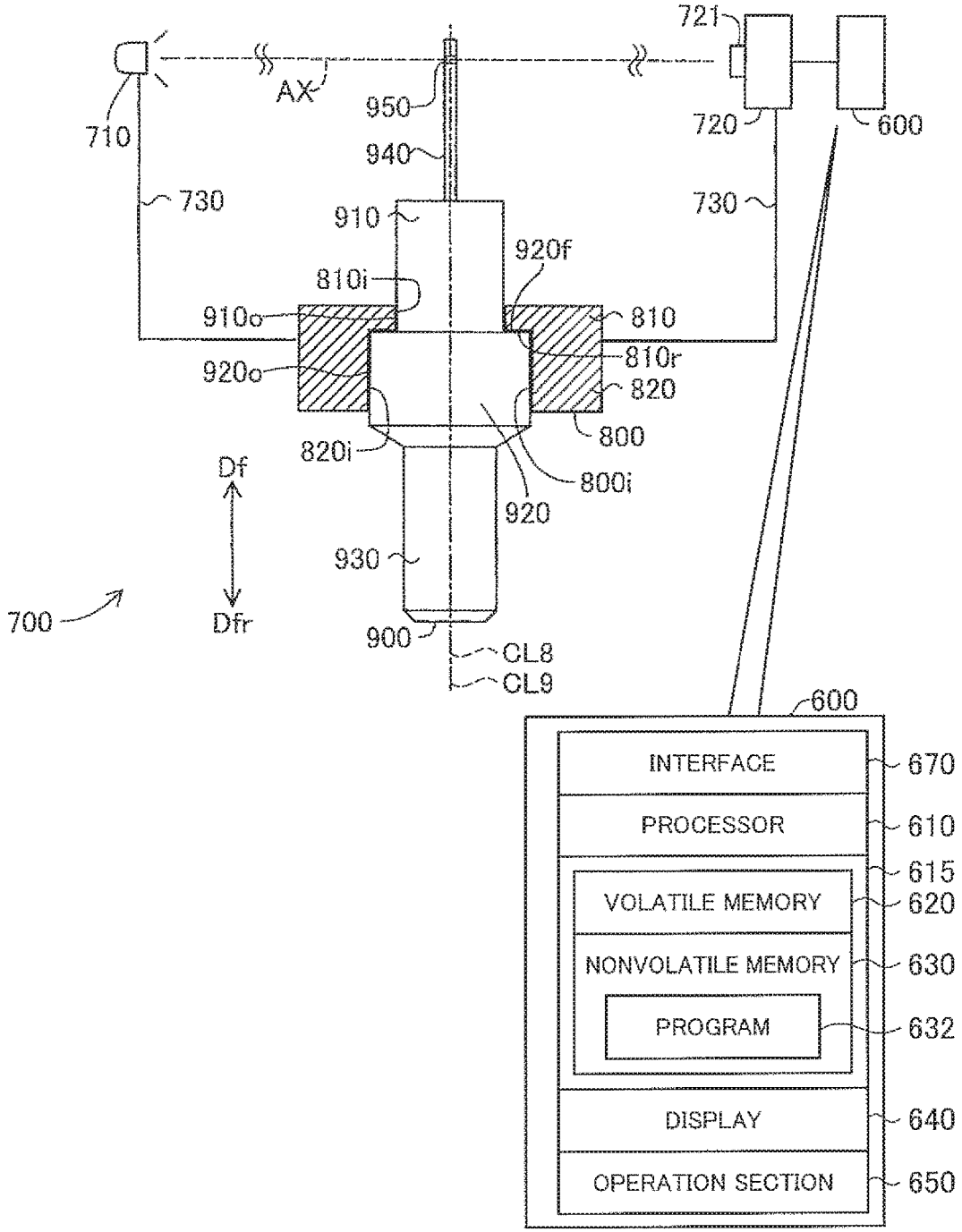
FIG. 3 is schematic view showing an image capturing system employed in one practical example of this embodiment.

At a step S100, a standard device is attached to a jig of an image capturing system or photographing system. FIG. 3 schematically shows the image capturing system employed in this practical example. In this practical example, the image capturing system 700 includes a light source 710 (LED light source, for example), a jig or holding tool 800, a digital camera 720 and a processing device 600 for analyzing image data obtained by the digital camera 720. The light source 710 is disposed approximately at the center of imaging range or coverage of digital camera 720. An axis AX shown in FIG. 3 is an optical axis of an optical system constituted by an optical unit 721 (including an imager and a lens) of digital camera 720 and the light source 710. The optical axis AX is a straight line connecting the optical unit 721 of digital camera 720 and the light source 710.

The jig or holding tool 800 is disposed between the light source 710 and digital camera 720. The position and orientation of jig 800 relative to digital camera 720 are determined in advance. The position of light source 710 relative to the digital camera 720 is also determined in advance. For example, the light source 710, digital camera 720 and jig 800 are mounted on and attached to a single common base 730. The standard device 900 is set or installed in jig 800.

The structure of processing device 600 is shown at a lower part of FIG. 3. For example, the processing device 600 is a personal computer (such as a desktop computer or a tablet computer). The processing device 600 shown in FIG. 3 includes a processor 610, a storage device 615, a display or display section 640 for displaying images and text, an input device or operation section 650 to be operated by a user and an interface 670. The storage device 615 of this example includes a volatile memory 620 and a nonvolatile memory 630. The elements of processing device 600 are connected with one another through bus or buses (not shown).

The processor 610 is a device for processing data, and the processor 610 is a CPU, for example. The volatile memory 620 is DRAM, for example. The nonvolatile memory 630 is flash memory, for example. A program 632 is stored in the nonvolatile memory 630. By executing the program, the processor 610 controls the digital camera 720, obtains image data from digital camera 720, analyzes the obtained image data, and determines whether the distance of gap g of spark plug 100 is within the allowable range or not (as explained later more in detail). The processor 610 temporarily stores various intermediate data used in the execution of the program, in the storage device 615 (in one of the volatile member 620 and the nonvolatile memory 630, for example)

The display section 640 includes a device for displaying imagery. For example, the display section 640 includes a liquid crystal display. The operation section 650 is a device or input device for receiving operation of the user. For example, the operation section 650 includes a touch panel disposed on the display section 640. The user or operator can input various commands into the processing device 600 by operating the operation device 650. The interface 670 is an interface for communication with other devices (for example, USB interface). The digital camera 720 is connected with this interface 670.

Figure 4A:
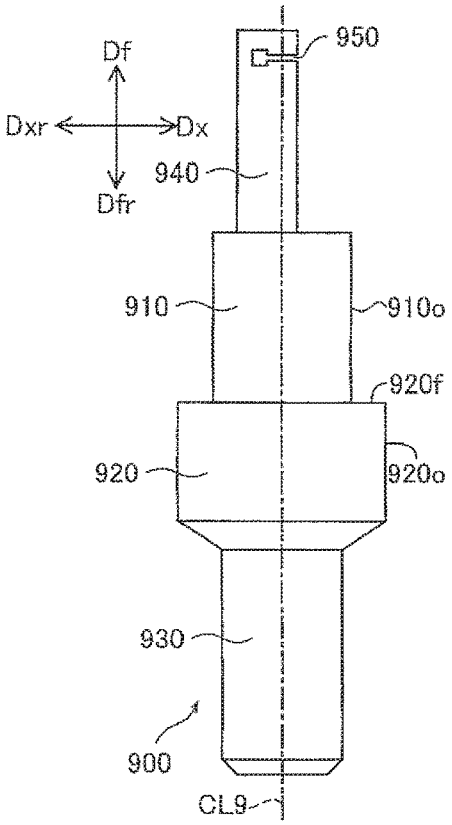
FIGS. 4A, 4B and 4C are views for illustrating a standard device 900 employed in this practical example.
Figure 4B:
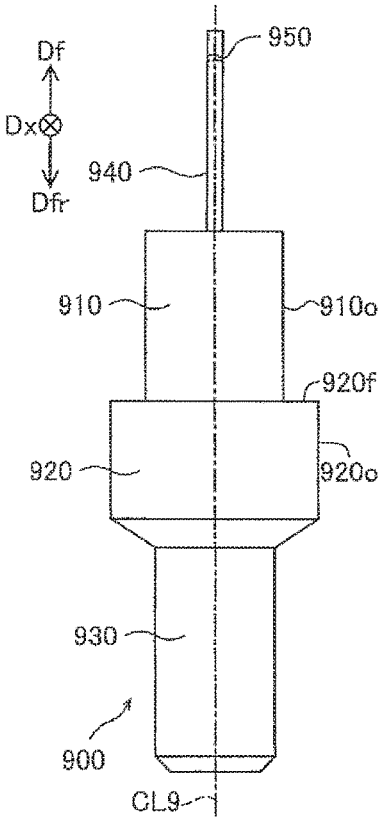

The standard device 900 is shown in FIG. 4. FIGS. 4A and 4B show a center axis CL (also referred to as axial line CL9) of standard device 900 and the appearance of standard device 900. FIGS. 4A and 4B show the appearance of standard device 900 as viewed from two different directions both of which are perpendicular to the axial line CL9.

Standard device 900 is a member imitating the spark plug 100 (shown in FIG. 1). Standard device 900 includes a slit forming section 940, a first portion 910, a second portion 920 and a third portion 930, which are arranged in this order along the axial line CL9 or device's longitudinal direction.

Each of first, second and third portions 910, 920 and 930 in this practical example is a cylindrical portion formed around the axial line CL9 as a common center axis. The second portion 920 corresponds to the middle trunk portion metal 54 of outer member 50 of spark plug 100 (shown in FIG. 1). The first portion 910 corresponds to the forward trunk portion 52 of outer metal member 50. The slit forming section 940 is in the form of a flat plate extending along the axial line CL9, and formed with a slit 950 extending in a direction perpendicular to the axial line CL9 (slit longitudinal direction). FIG. 4A is a schematic view as viewed from a direction perpendicular to the flat slit forming section 940. FIG. 4B is a schematic view as viewed from a direction parallel to the flat slit forming section 940. The slit 950 corresponds to the gap g formed between the electrodes 20 and 30 (shown in FIG. 1).

The direction from third portion 930 toward the slit forming section 940 in parallel to axial line CL9 (i.e. the upward direction in FIG. 4A) corresponds to the forward direction Df in FIG. 1 (hereinafter, referred to as forward direction Df or front direction Df by using the same symbol. The opposite direction is referred to as rearward direction Dfr or rear direction Dfr.).

The outside diameter of second portion 920 is substantially equal to the outside diameter of middle trunk portion 54 of outer metal member 50. The outside diameter of first portion 910 is substantially equal to the outside diameter of forward trunk portion 54 of outer metal member 50. The outside diameter of second portion 920 is greater than the outside diameter of first portion 910. That is, the second portion 920 projects radially outward in a direction perpendicular to axial line CL9. Second portion 920 includes a shoulder surface or step surface 920*f* which faces in the forward direction Df and which is formed between an outside circumferential surface 920*o* of second portion 920 and an outside circumferential surface 910*o* of first portion 910. This shoulder surface 920*f* (also referred to as seat surface 920*f*) corresponds to the shoulder surface or seat surface 54*f* of middle trunk portion 54 of outer metal member 50 (shown in FIG. 1). The outside diameter of second portion 920 is greater than the outside diameter of third section 930. In this example, the shoulder surface 920*f* is an annular surface. For example, the shoulder surface 920*f* is an annular flat surface.

Figure 4C:
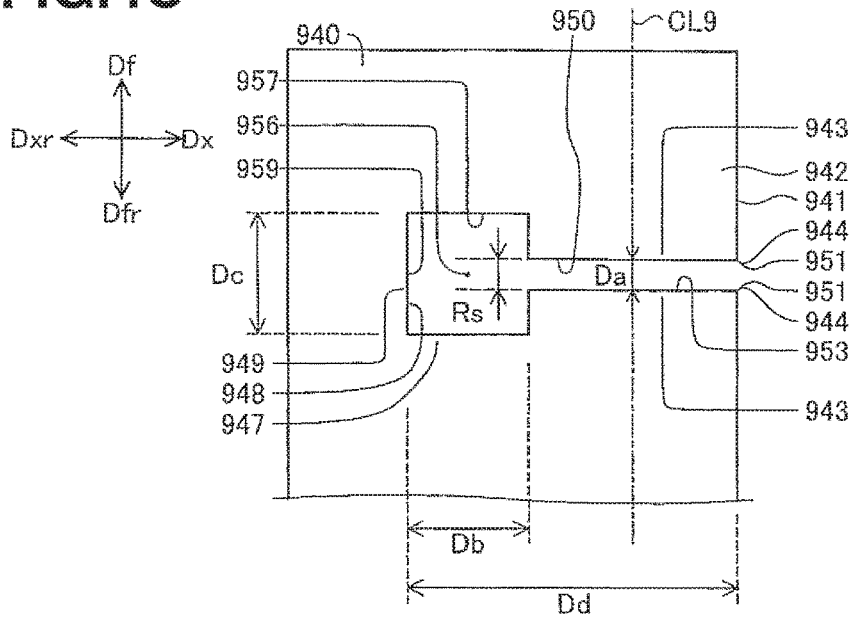

FIG. 4C is an enlarged view showing the slit 950 formed in the slit forming portion 940 shown in FIG. 4A. In the figures, first and second directions Dx and Dxr are shown in addition to the forward direction Df and rearward direction Dfr. The first and second directions Dx and Dxr are directions perpendicular to the axial line CL9. The second direction Dxr is a direction opposite to the first direction Dx. The slit forming section 940 is in the form of a flat plate parallel to these directions Df, Dfr, Dx and Dxr. Df and Dfr are two opposition directions of the device longitudinal direction of standard device 900, and Dx and Dxr are two opposite directions of the slit longitudinal direction of slit 950.

The slit 950 of this practical example includes a standard segment or standard slit segment 953 and a wide (slit) segment 957 having a width greater than the width of standard slit segment 953. The standard slit segment 953 extends from the wide slit segment 957 in the first direction Dx of the slit longitudinal direction which is perpendicular to axial line CL 9, with a predetermined width Da. The width Da is a width measured in a direction (slit widthwise direction) perpendicular to the slit longitudinal direction which is a direction in which the standard slit segment 953 extends. (The slit widthwise direction is a direction parallel to axial line CL9 or to the device longitudinal direction.) The standard slit segment 953 extends in the slit longitudinal direction across the center axial line CL9. The wide slit segment 957 has a width Dc which is greater than the width Da of standard slit segment 953. The width Dc of wide slit segment 957 is a width measured in the (widthwise) direction perpendicular to the longitudinal direction of standard slit segment 953 (that is a direction parallel to axial line CL9). In this practical example, the wide slit segment 957 is substantially in the form of a rectangle having two sides parallel to axial line CL9 and two sides perpendicular to axial line CL9. In this example, the rectangle is a square, and the wide slit segment 957 is square-shaped. In this example, the standard slit segment 953 extends from a middle of one side of wide slit segment in the first direction Dx.

The slit forming section 940 includes a first portion defining the standard slit segment 953, a second portion 947 defining the wide slit segment 957 and a third portion 942 defining a first side 941 facing in the first direction Dx on the first direction Dx side (which the right side as viewed in FIG. 4C). As shown in the figure, the first portion 943 includes a first end portion 944 which is an end portion on the first direction Dx side (right side in FIG. 4C) and which defines a first slit end 951 of standard slit segment 953. The standard slit segment 953 extends in the first direction Dx (or the longitudinal direction of the slit 950) to the first slit end 951 which is open in the first side 941 (of the slit forming section 940).

The wide slit segment 957 having the width Dc greater than width Da of standard slit segment 953 is formed in the second portion 947 of the slit forming section 940, and located so that the standard slit segment 953 is located between the first slit end 951 and the wide slit segment 957 or that the standard slit segment 953 extends longitudinally from the first slit end 951 on the first direction Dx side (right side) to the wide slit segment 957 on the second direction Dxr side (left side as viewed in FIG. 4C).

The slit 950 extends, in the second direction Dxr (leftward direction in FIG. 4C), from the first slit end 951 which is open, to a second slit end 959 which is closed. The second portion 947 defining the wide slit segment 940 includes a portion 949 defining the second slit end 959. This portion 949 forms a straight edge 948 extending in a direction (slit widthwise direction) perpendicular to the longitudinal direction (slit longitudinal direction) of the standard slit segment 953. Thus, the second slit end 959 is formed by the straight edge 948 (also referred to as edge 959) extending in the direction (slit widthwise direction) perpendicular to the longitudinal direction (slit longitudinal direction) of standard slit segment 953.

The third portion 942 of slit forming section 940 forms the first side 941 in the form of a straight side or end extending in a direction (slit widthwise direction) perpendicular to the longitudinal direction of standard slit segment 953. The side or end 941 is also referred to as edge 941 hereinafter. The slit forming section 940 is bounded between the first side 941 on the first direction Dx side (right side in FIG. 4C) and a second side on the second direction Dxr side (left side in FIG. 4C). The standard slit segment 953 extends from the first slit end 951 which is opened in the first side 941, in the slit longitudinal direction (the second direction Dxr) to an end of the standard slit segment 953 at which the standard slit segment 953 opens into the wide slit segment 957, which extends from end of the standard slit segment 953 to the second slit end 959 which is spaced from the second side of the slit forming section 940, and which is closed.

In FIG. 4C, a center 956 of wide slit segment 957 is shown. The center 956 is a center of the square (or rectangle) formed by the wide slit segment 957. In this practical example, the position of center 956 in the direction (slit widthwise direction) perpendicular to the longitudinal direction of standard slit segment 953 (the position in the direction parallel to the axial line CL9 in this example) is within a range Rs of the width of standard segment 953. In this example, the standard slit segment 953 is bounded between two parallel straight edges extending in the longitudinal direction of the standard slit segment 953, and the center 956 is located between extensions of the two parallel straight edges (as shown by broken lines in FIG. 4C). In other words, the position of the center 956 of wide slit segment 957 in the direction (slit widthwise direction) perpendicular to the slit longitudinal direction in which the standard slit segment 953 extends is located between the positions of the two parallel edges of standard slit segment 953 in the direction (slit widthwise direction) perpendicular to the slit longitudinal direction.

FIG. 4C shows parameters Da~Dd representing the configuration of slit 950. As explained before, the width Da is the width of standard slit segment 953 as measured in the direction (slit widthwise direction) perpendicular to the longitudinal direction of standard slit segment 953. As explained before, the width Dc is the width of wide slit segment 957 as measured in in the direction (slit widthwise direction) perpendicular to the longitudinal direction of standard slit segment 953. In this practical example, the standard slit segment 953 extends in the slit longitudinal direction which is perpendicular to the axial line CL9 (or a device longitudinal direction of standard device 900). Accordingly, the widths Da and Dc are dimensions measured in the direction parallel to the axial line CL9. Db is the length of wide slit segment 957 as measured in the longitudinal direction of standard slit segment 953 (which is perpendicular to the axial line CL 9, in this example). Dd is the length of slit 950 as measured in the longitudinal direction of standard slit segment 953 (which is perpendicular to the axial line CL 9, in this example). The length Dd of slit 950 is the distance between the first slit end 951 and the second slit end 959. In this practical example, the length Dd is equal to the distance between edge or side 941 and edge 948. These sizes Da, Db, Dc and Dd are preliminarily determined.

Figure 5:
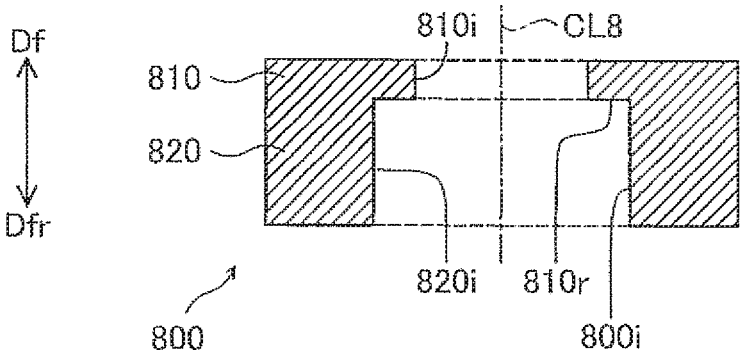
FIG. 5 is a view for illustrating a jig 800 employed in this practical example.

FIG. 5 shows the jig or holding device 800. FIG. 5 shows a center axis CL8 (also referred to as axial line CL8) of jig 800 and a section including the axial line CL8 of jig 800. Jig 800 is a ring-shaped member having a through hole 800*i* extending along the axial line CL8. Jig 800 extends axially along CL8 from a first end to a second end, and includes a first portion 810 extending from the first end (upper end as viewed in FIG. 5) toward the second end (lower end in FIG.

5) and a second portion 820 extending from the second end (lower end) to the first portion 810. The through hole 800*i* extends through the first and second portions 810 and 820. The inside diameter of second portion 820 is greater than the inside diameter of first portion 810. The jig 800 is made of metallic material, for example.

The first portion 810 of jig 800 is formed to receive the first portion 910 of standard device 900 (cf. FIG. 4A), and the forward trunk portion 52 of outer metal member 50 (cf. FIG. 1). For example, the inside diameter of first portion 810 is approximately equal to the outside diameter of first portion 910 of standard device 900 and equal to the outside diameter of forward trunk portion 52 of outer metal member 50. Accordingly, the first portion 910 of standard device 900 or the forward trunk portion 52 of metal shell 50 can be fit in the first portion 810 of jig 800.

The second portion 820 of jig 800 is formed to receive the second portion 920 of standard device 900 (cf. FIG. 4A), and the middle trunk portion 54 of outer metal member 50 (cf. FIG. 1). For example, the inside diameter of second portion 820 is approximately equal to the outside diameter of second portion 920 of standard device 900 and equal to the outside diameter of middle trunk portion 54 of outer metal member 50. Accordingly, the second portion 920 of standard device 900 or the middle trunk portion 54 of metal shell 50 can be fit in the second portion 820 of jig 800.

In the fitting or set state in which the spark plug 100 or the standard device 900 is fit in jig 800, as mentioned later, the direction from the second portion 820 to the first portion 810 in parallel to axial line CL8 (the upward direction in FIG. 5) corresponds to the forward direction Df shown in FIG. 1 and FIG. 4A. (Hereinafter, this direction is referred to as forward direction Df or front direction Df using the same symbol. The opposite direction (downward in FIG. 5) is referred to as rearward direction Dfr or rear direction Dfr.)

The inside diameter of first portion 810 of jig 800 is smaller than the inside diameter of second portion 820. A shoulder surface or step surface 810*r* is formed between an inside circumferential surface 810*i* of first portion 810 and an inside circumferential surface 820*i* of second portion 820 so that the inside circumferential surfaces 810 and 820 are connected by the shoulder surface 810*r*. The shoulder surface 810*r* faces in the rearward direction Dfr toward the second (lower) end of jig 800, and serves as a support portion for supporting or abutting against the seat surface 54*f* of middle trunk portion 54 of outer metal member 50 (FIG. 1) and the seat surface 920*f* of standard device 900 (FIG. 4A) (this shoulder surface is also referred to as support portion 810*r*). In this example, the shoulder surface 810*r* is an annular surface. Specifically, in this example, the shoulder surface 810*r* is an annular flat surface facing in the rearward direction Dfr.

FIG. 3 shows a section of jig 800 including the axial line CL8, and the appearance of standard device 900 set in jig 800. As shown in FIG. 3, the standard device 900 is fit in the through hole 800*i* of jig 800. A front part of second portion 920 of standard device 900 on the front Df direction side is located in the second portion 820 of jig 800. A rear part of first portion 910 of standard device 900 on the rearward direction Dfr side is located in the first portion 810 of jig 800. In the through hole 800*i*, the axial line CL9 of standard device 900 is substantially coincident and collinear with the axial line CL8 of jig 800. For example, the axial lines CL8 and CL9 are aligned so that both axial lines are coincident, by contact between the outside circumferential surface 920*o* of second portion 920 of standard device 900 and the inside circumferential surface 820*i* of second portion 820 of jig 800.

Moreover, in the through hole 800*i* of jig 800, the forward-facing shoulder surface 920*f* of second portion 920 of standard device 920 facing toward the slit forming section 940 abuts on the rearward-facing shoulder surface or support portion 810*r* of jig 800 facing in the rearward (downward) direction Dfr. Thus, the support portion 810*r* of jig 800 supports the seat surface 920*f* of standard device 900, and thereby prevents undesired shift in the position and orientation of standard device 900 relative to jig 800.

When the standard device 900 is set in jig 800 in this way, the slit 950 of standard device 900 is positioned in the vicinity of the optical axis AX. The orientation of standard device 900 in the circumferential direction around the center axis CL8 or CL9 is adjusted so that the slit forming section 940 is set substantially perpendicular to the optical axis AX.

At a step S105 of FIG. 2, an operator or user inputs a command to start a process of the standard device 900 by operating the operation section 650 of processing device 600 (FIG. 3). In response to this command, the processor 610 starts the process according to a program 632. Specifically, at step S105, the processor 610 takes a picture of the standard device 900 in digital form by controlling the digital camera 720. Then, the processor 610 obtains image date produced by the shooting or image capturing operation, from the digital camera 720. Under the control of processor 610, the digital camera 720 produces image data (referred to as standard image data) representing a standard image which is image including an image of the slit 950 of standard device 900. In this practical example, the standard image data is in the form of bitmap data representing the standard image. In the bitmap data, each of pixels representing the standard image has a color value. The color value of each pixel includes values of three color components, red (R), green (G) and blue (B) (also referred to as R value, G value and B value). The number of gradation levels or greyscale levels of each color component is 256, for example.

Figure 6A:
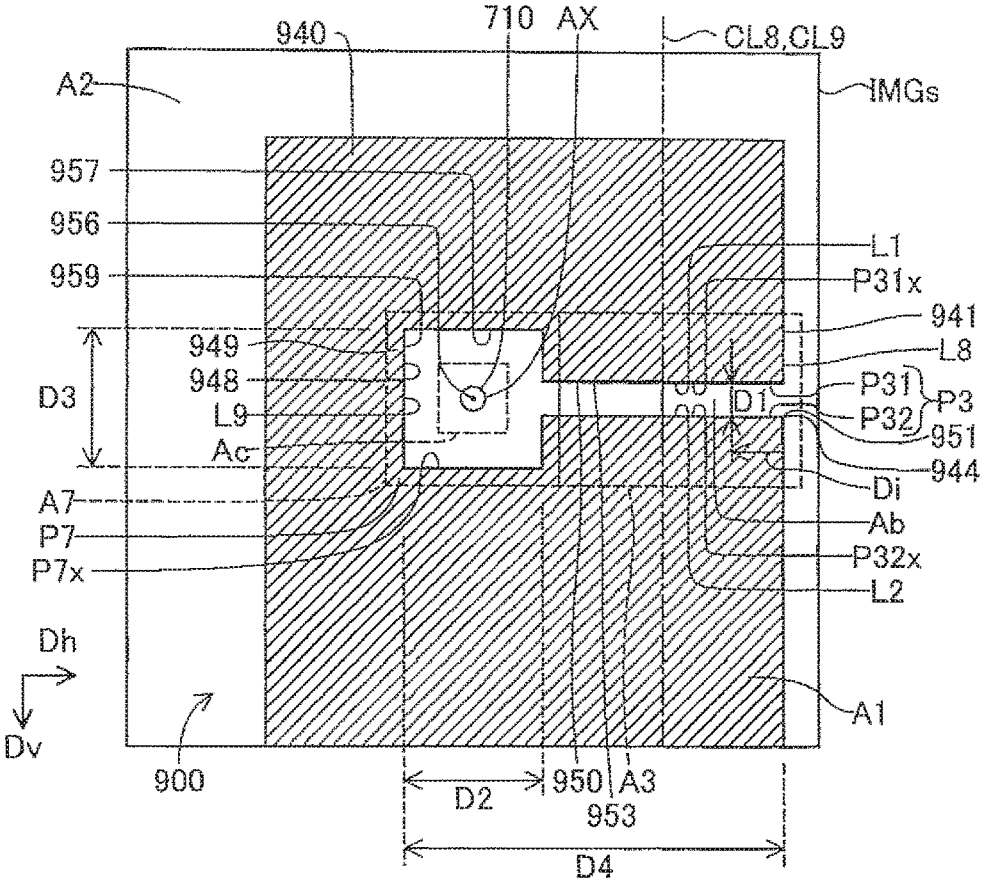
FIG. 6A is a view showing an example of standard image in this practical example and FIG. 6B is a view showing a histogram showing an example of a distribution of luminance values Y.

FIG. 6A is a view for illustrating an example of the standard image. This standard image IMGs shows a portion of slit forming section 940 which includes the slit 950. The standard image IMGs of this example is a proper image captured in the state in which the axial lines CL8 and CL9 are substantially perpendicular to the optical axis AX and the slit forming section 940 is substantially perpendicular to the optical axis AX, as explained with reference to FIG. 3.

The standard image IMGs is in the form of a matrix of pixels arranged in a rectangle along horizontal direction Dh and vertical direction Dv perpendicular to each other. The slit forming section 940 is disposed between the light source 710 and the digital camera 720, as shown in FIG. 3. Accordingly, in the standard image IMGs, a standard device region A1 representing the standard device 900 (the slit forming section 940, to be exact) is relatively dark, and a background region A2 representing a background including slit 950 is relatively bright. Moreover, as shown in FIG. 6A, the position of light source 710 is adjusted so that the position of light source 710 is positioned at the center 956 of wide slit segment 957.

FIG. 6A shows parameters D1, D2, D3 and D4 in standard image IMGs. These parameters D1, D2, D3 and D4 correspond, respectively, to the parameters Da, Db, Dc and Dd shown in FIG. 4C. As mentioned later, the width D1 in standard image IMGs is used for calibrating or correcting the distance of gap g in an image representing the spark plug 100. (Hereinafter, the width D1 is also referred to as standard image length D1.) The lengths D2, D3 and D4 are used for adjusting the positions of light source 710 and standard device 900.

The standard image length D1 in standard image IMGs can vary for various reasons. For example, edges P31*x* and P32*x* defining the standard slit segment 953 of slit 950 in the standard device region A1 of standard image IMGs can be blurred because of diffraction of light pasting through the slit 950. The blur of edges P31*x* and P32*x* due to the diffraction can be varied in dependence on the position of light source 710 in standard image UMGs and the light quantity of light source 710. The width D1 in standard image IMGs can be varied by variation of the blur of edges P31*x* and P32*x*. Furthermore, the distance between edges P31*x* and P32*x* can be varied because of inclination of the standard device 900 with respect to the digital camera 720.

Figure 7A:
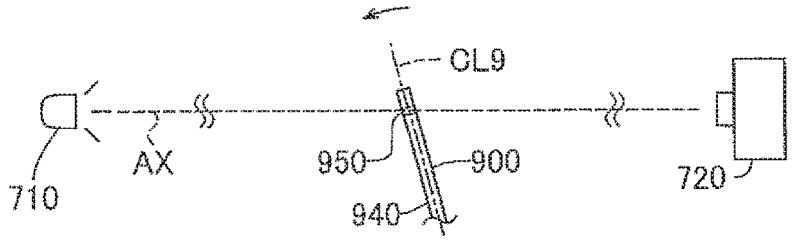
FIGS. 7A and 7B are views for illustrating inclination of the jig 900 and variation of a standard image length D1.
Figure 7B:
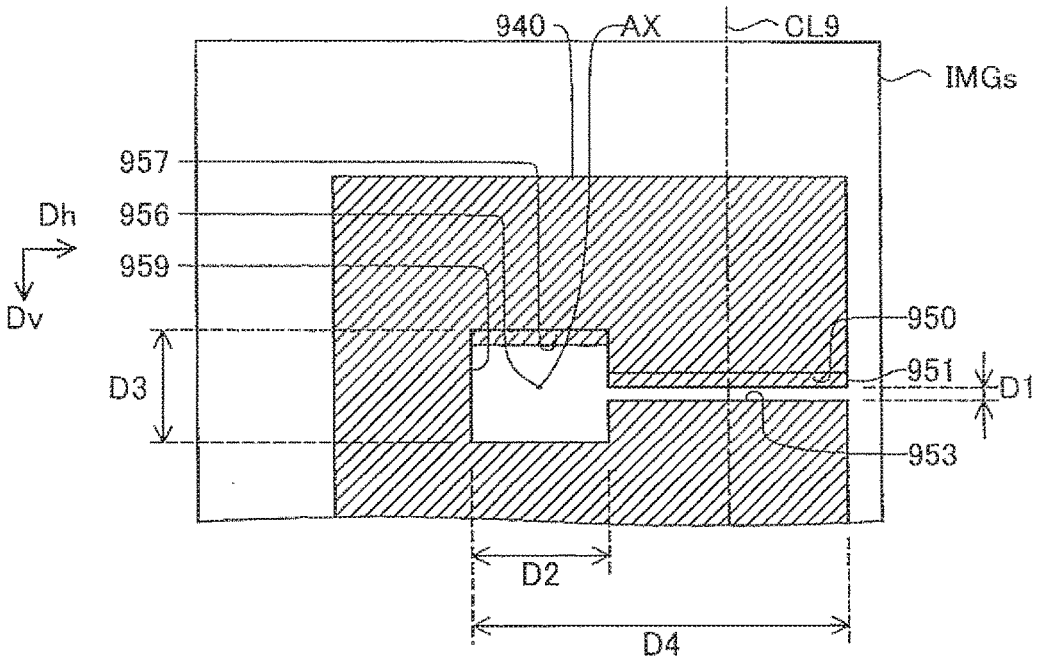

FIGS. 7A and 7B and FIGS. 8A and 8B are views for illustrating the inclination of standard device 900 and the variation of standard image length D1. FIG. 7A shows a positional relationship between the light source 710, the digital camera 720 and the slit forming section 940 of standard device 900 in one example. In the example of FIG. 7A, the axial line CL9 of standard device 900 is not perpendicular to the optical axis Ax, but inclined. FIG. 7B shows an example of the standard image IMGs taken in the state of FIG. 7A. Since the axial line CL9 is inclined with respect to the optical axis Ax, in the standard image IMGs taken by digital camera 720, the slit forming section 940 appears to shrink in the direction along axial line CL9. Therefore, the standard image length D1 and the length D3 which are dimensions in the direction substantially parallel to the axial line CL9, become shorter as compared to the standard image length D1 and length D3 in the proper standard image IMGs shown in FIG. 6A. Moreover, since the width of standard slit segment 953 is smaller as viewed from the digital camera 720, the degree of blur in edges P31*x* and P32*x* due to diffraction of light can be different from the degree of blur in in edges P31*x* and P32*x* in the proper standard image IMGs.

Figure 8A:
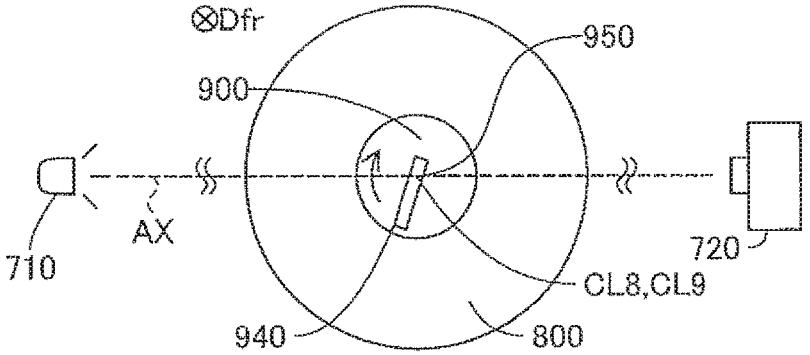
FIGS. 8A and 8B are views for illustrating inclination of the jig 900 and variation of the standard image length D1.
Figure 8B:
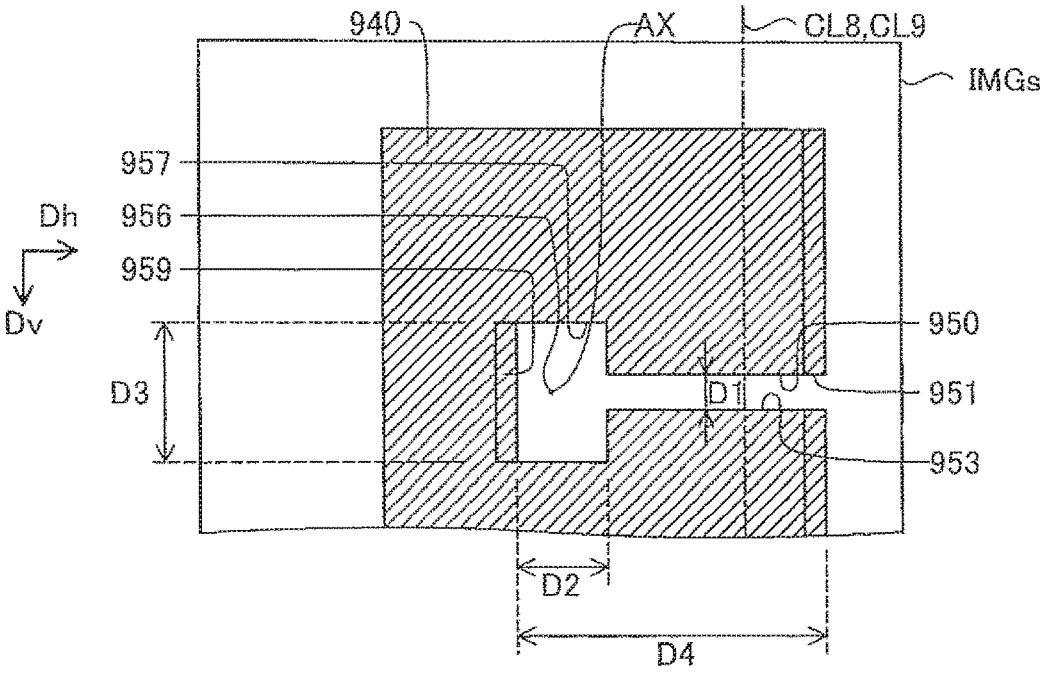

FIG. 8A shows a positional relationship between the light source 710, the digital camera 720 and the slit forming section 940 of standard device 900 in another example. In the example of FIG. 8A, the standard device 900 is rotated about the axial line CL9 and the slit forming section 940 is inclined with respect to the optical axis Ax. FIG. 8B shows an example of the standard image IMGs taken in the state of FIG. 8A. Since the slit forming section 940 is inclined with respect to the optical axis Ax, in the standard image IMGs taken by digital camera 720, the slit forming section 940 appears to shrink in the direction perpendicular to the axial line CL9. Therefore, the lengths D2 and D4 which are dimensions in the direction substantially perpendicular to the axial line CL9, become shorter as compared to the lengths D2 and D4 in the proper standard image IMGs shown in FIG. 6A.

When the slit forming section 940 is inclined with respect to the optical axis Ax as in FIG. 8A, the light from light source 710 passes obliquely through the slit 950. Therefore, in the path of the light from light source 710 to digital camera 720, the length of the path in the slit 950 (standard slit segment 953, for example) becomes longer as compared to the proper state in which the slit forming section 940 is perpendicular to the optical axis AX (and the proper standard image IMGs can be obtained as shown in FIG. 6A). When the length of the path of the light in the standard slit segment 953 of slit 950 is longer, the degree of blur in edges P31*x* and P32*x* due to diffraction of light can be different from the degree of blur in in edges P31*x* and P32*x* in the proper standard image IMGs.

In this way, the improper setting in which the axial line CL9 is inclined with respect to optical axis AX and the improper setting in which the slit forming section 940 is inclined with respect to optical axis could cause the improper standard image IMGs as shown in FIG. 7B or FIG. 8B, and cause an improper value of the standard image length D1. As explained with reference to FIGS. 7A and 7B, it is possible to determine whether the axial line CL9 is inclined with respect to optical axis AX or not, by using length D3. As explained with reference to FIGS. 8A and 8B, it is possible to determine whether the slit forming section 940 is inclined with respect to optical axis AX or not, by using length D2 and/or D4.

At steps S110 and S113, the processor 610 determines the lengths D2, D3 and D4 in standard image IMGs by analyzing the standard image data. It is possible to employ any of various methods to determine the lengths D2, D3 and D4. In this practical example, the processor 610 first divides the standard image IMGs into a standard device region A1 representing the standard device 900 and a background region A2 representing the background, at step S110.

To divide the standard image IMGs into the standard device region A1 and the background region A2, it is possible to employ any of various methods. In this practical example, processor 610 demarcates the standard device region A1 and the background region A2 from each other, by using the distributions of luminance values of pixels. The luminance is calculated according to a predetermined calculation formula by using the values of three color components, red R, green G and blue B. For example, the luminance is calculated by using a known relationship relating the gradation levels of RGB color space and the luminance in YCbCr color space.

Figure 6B:
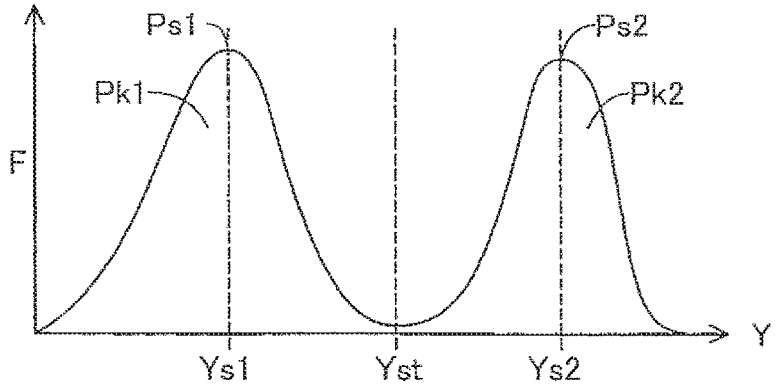

FIG. 6B is an image histogram showing the distribution of values of luminance Y. The horizontal axis represents the luminance Y and the vertical axis represents the frequency F of pixels. As shown in FIG. 6B, the histogram of luminance Y shows a relatively dark first peak Pk1 representing the standard device region A1 and a relatively bright second peak Pk2 representing the background region A2. Processor 610 analyzes the standard image data, calculates a value of the luminance Y of each pixel, and produce a histogram representing the distribution of luminance values Y. Then, by analyzing the histogram, the processor 610 identifies pixels of the first peak Pk1 (standard device region A1, that is) and pixels of the second peak Pk2 (background region A2, that is). As to the method for separating the two peaks, it is possible to employ one of various methods. In this practical example, the processor 610 determines the luminance value Ys1 of the summit Ps1 of first peak Pk1 and the luminance value Ys2 of the summit Ps2 of second peak Pk2. Then, processor 610 employs, as a threshold Yst, an average of the luminance values Ys1 and Ys2 of the summits Ps1 and Ps2. Processor 610 classifies the pixels having luminance values lower than the threshold Yst into the pixels of first peak Pk1, that is the pixels of standard device region A1. Processor 610 classifies the pixels having luminance values higher than or equal to the threshold Yst into the pixels of second peak Pk2, that is the pixels of background region A2. It is optional to determine the threshold Yst in one of various other methods. For example, it is possible to employ, as the threshold Yst, the luminance value of the lowest frequency F in a valley between the first and second peaks Pk1 and Pk2.

At a step S113 of FIG. 2, the processor 610 identifies the portions corresponding to lengths D2, D3, D4 in at least one of the regions A1 and A2, and determines the lengths D2, D3 and D4 by using the identified portions. In this practical example, the processor 610 identifies a standard image portion P3 forming the standard slit segment 953 of slit 950 and a wide image portion P7 forming the wide slit segment 957 in the standard device region A1. The standard image portion P3 is made up of two portions P31 and P32 spaced from each other. The wide image portion P7 is approximately in the annular shape or shape of a frame. These portions can be discriminated by various methods. For example, at step S100 of FIG. 2, the standard device 900 (FIG. 31) is disposed so that the slit forming section 940 is positioned at a predetermined position in the standard image IMGs. In this case, processor 610 can employ, as the standard image portion P3, a portion in a predetermined range A3 in the standard image IMGs, and employ, as the wide image portion P7, a portion in a predetermined range A7. In this practical example, the standard device 900 is oriented in a predetermined direction, or the axial line CL9 of standard device 900 is extended in a predetermined direction in the standard image IMGs. More specifically, the axial line CL9 is substantially parallel to the vertical direction Dv.

By using the specified portions P3 and P7, the lengths D2, D3 and D4 can be determined by various methods. For example, the two portions P31 and P32 representing the standard slit segment 953 form edges P31*x* and P32*x*, respectively. These edges P31*x* and P32*x* represent the edges of standard slit segment 953, and these edges P31*x* and P32*x* are substantially parallel to each other. Processor 610 calculates one of straight lines or edge straight lines L1 and L2, respectively, approximating the edges P31*x* and P32*x* of portions P31 and P3. The straight line or edge straight line (either of straight lines L1 and L2) is a straight line approximating the positions of pixels representing the corresponding one of edges P31*x* and P32*x*. This straight line or edge straight line can be determined by the least squares method or Hough transform, for example. When a plurality of straight lines are detected, it is possible to employ, as the edge straight line, a straight line forming a smallest angle with the horizontal direction Dh. A direction parallel to the calculated straight line is used as the direction (slit longitudinal direction) in which the standard segment 953 extends. Processor 610 calculates, as the length D2, a length of a region surrounded by an inside circumferential edge P7*x* of the wide image portion P7 (a region corresponding to the wide slit segment 957 of slit 950), in a direction parallel to the direction (slit longitudinal direction) in which the standard slit segment 953 extends, and calculates, as the length D3, a length in a direction (slit widthwise direction) perpendicular to the direction (slit longitudinal direction) in which the standard segment 953 extends. Furthermore, processor 610 calculates, as length D4, a length of a region surrounded and bounded by the edge P7*x* of wide image portion P7 and the edges P31*x* and P32*x* of standard image portion P3 (a region corresponding to the slit 950) in the standard device region A1, as measured in the direction in which the standard slit segment 953 extends. The unit of measurement of lengths D2, D3 and D4 may be any of units representing lengths in standard image IMGs. For example, lengths D2, D3 ad D4 are expressed by a number of pixels.

As explained with reference to FIG. 4C, the portion 949 defining the edge 959 on the second direction Dxr side of slit 950 in the slit forming section 940 forms the straight edge 948 extending in the direction perpendicular to the slit longitudinal direction in which the standard slit section 953 extends. Therefore, processor 60 may identify a straight line L9 approximating the arrangement of pixels representing the straight edge 948 and use a direction perpendicular to this straight line L9, as the slit longitudinal direction in which the standard segment 953 extends. For example, the lengths D2 and D4 can be calculated by calculating the lengths in the direction perpendicular to the straight line L9. In this case, it is possible to improve the accuracy of lengths D2 and D4 and hence to improve the accuracy in determining the orientation of standard device 900 in the circumferential direction.

Moreover, as explained with reference to FIG. 4C, the edge portion 941 of the slit forming section 940 on the first direction Dx side is a straight edge extending in the direction perpendicular to the slit longitudinal direction in which the standard slit segment 953 extends. Therefore, processor 610 may identify a straight line L8 approximating the arrangement of pixels representing the edge 941 (FIG. 6A) and calculates, as length D4, the distance between this straight line L8 and the before-mentioned straight line L9 representing the edge on the second direction Dxr side.

At step S113 of FIG. 2, processor 610 determines the position of light source 710 and the luminance at the standard slit segment 953 of slit 950 in the standard image IMGs, in addition to the lengths D2, D3 and D4 (FIG. 6A). The position of light source 710 can be determined by various methods. In this practical example, the position of a center or a centroid of a region of one or more continuous brightest pixels is employed as the positon of light source 710. The centroid of a region is the position of center of gravity on the assumption that the mass is distributed uniformly in the region. In place of this method, it is possible to determine the position of light source 710 by pattern matching using a predetermined shape of light source 710.

As the luminance at standard slit segment 953, it is possible to employ an average luminance value in a region Ab bounded between the edges P31*x* and P32*x* of standard slit segment 953, for example. Instead of the average, it is optional to employ one of various representative values (such as the most frequent value and median) obtained from luminance values of pixels.

At S115 of FIG. 2, the processor 610 determines whether the disposition or arrangement of standard device 900 and light source 710 and the light quantity of light source 710 are proper or not. In this practical example, processor 610 judges that the disposition of standard device 900 and light source 710 and the light quantity of light source 710 are proper or adequate when all of the following five conditions are satisfied.

Condition 1) The position of light source 710 is within a predetermined allowable range Ac including the center 956 of wide slit segment 957. (In the example of FIG. 6A, the allowable range Ac has a shape such as a square and the center of the allowable range Ac coincides with the center 956 of wide slit segment 956.)

Condition 2) The luminance of standard slit segment 953 is within a predetermined allowable range of the luminance.

Condition 3) The length D2 is within a predetermined allowable range of length D2.

Condition 4) The length D4 is within a predetermined allowable range of length D4.

Condition 5) The length D3 is within a predetermined allowable range of length D3.

Each of the allowable ranges of the dimensions D2, D3 and D4, the position of light source 710 and the luminance of standard slit segment 953 is specified by an upper limit and a lower limit, for example. These allowable ranges are experimentally determined in advance. When the dimensions D2 and D4 are outside the respective allowable ranges (D2 and D4 are smaller than the respective allowable ranges, for example), the slit forming section 940 is inclined with respect to the optical axis AX, as explained with reference to FIG. 8B. Moreover, when the dimension D3 is outside the allowable range of D3 (D3 is smaller than its allowable range, for example), the axial line CL9 of standard device 900 is inclined with respect to optical axis AX, as explained with reference to FIG. 7B.

When at least one of the conditions 1~5 is not satisfied (S115: No), then the processor 610 outputs information representing the result of the judgment to a device for receiving the information at S117, and terminates the process of standard device 900. For example, the processor 610 delivers the information representing the result of the judgment to the display section 640 and causes the display section 640 to show the result of the judgment. The user or operator can watch the display 640 and know the result of the judgment. Preferably, the information of the result includes an information item specifying one or more conditions which are not satisfied.

At S119, the user adjusts the position of light source so that the condition 1 is satisfied (the light source 710 is positioned within the allowable range Ac). When the condition 1 is already satisfied, S119 is omitted.

At S120, the user adjusts the light quantity of light source so that the condition 2 is satisfied (the luminance of standard slit segment 953 is within the allowable range). When the condition 2 is already satisfied, S120 is omitted.

At S125, the user adjusts the orientation of jig 800 so that the condition 5 is satisfied (the axial line CL9 of standard device 900 is perpendicular to optical axis Ax). When the condition 5 is already satisfied, S125 is omitted.

At S130, the user adjusts the orientation of standard device 900 in the circumferential direction so that the conditions 3 and 4 are satisfied (the slit forming section 940 is perpendicular to optical axis Ax). When the conditions 3 and 4 are both already satisfied, S130 is omitted.

It is optional to employ the arrangement in which the processor 610 controls the light source 710 and thereby adjusts the light quantity and position of light source 710. Furthermore, it is optional to employ the arrangement in which processor 610 adjusts the orientation of jig 800. It is optional to employ the arrangement in which processor 610 adjusts the orientation of standard device 900 in the circumferential direction.

After S130, the processor 610 proceeds to S105. Then, processor 610 newly obtains the standard image data. Steps S110~S115 are repeated by using the newly obtained standard image data.

When processor 610 judges, at S115, that the disposition of standard device 900 and light source 710 and the light quantity of light source 710 are proper (S115: Yes), then the processor 610 proceeds to a step S140, and output the information on the result of the judgment to the device receiving the information at S140, in the same manner as S117.

At a step S145 next to S140, the processor 610 determines the standard image length D1 by using a portion corresponding to standard image length D1 in at least one of the regions A1 and A2 (FIG. 6A) shown by the most recent (and hence proper) standard image data. The standard image length D1 can be determined by various methods. In this practical example, processor 610 calculates the standard image length D1 by using the standard image portion P3 determined at S113. In this practical example, processor 610 calculates, as the standard image length D1, a distance between the two edges P31*x* and P32*x* (as measured in the direction perpendicular to the longitudinal direction of standard slit segment 953, in this example) at a position spaced inwards by a predetermined distance Di from the end 944 defining the open slit end 951, toward the edge 948 defining the closed slit end, and sets the standard image length D1 equal to the thus-calculated distance between the two edges P31*x* and P32. Instead of this calculation method, the processor 610 can calculate the standard image length D1 in the following manner. As mentioned before, the two edges P31*x* and P32*x* of standard image portion P3 extend in parallel to the longitudinal direction of standard slit segment 953. Therefore, the shortest distance between the two edges P31*x* and P32*x* is a distance in the direction perpendicular to the longitudinal direction of standard segment 953. Accordingly, processor 610 can employ, as the standard image length D1, the shortest distance between the two edges P31*x* and P32*x*. Moreover, the processor 610 may be configured to calculate two straight lines L1 and L2 approximating the two edges P31*x* and P32*x*, respectively, and to calculate, as the standard image length D1, the distance between the two straight lines L1 and L2. The unit of standard image length D1 may be any of units for measurement of a length in standard image IMGs. For example, the standard image length D1 is measured by the number of pixels.

At a step S150, processor 610 stores the information on the standard image length D1 in the storage device 615 (for example, in one of volatile memory 620 and nonvolatile memory 630) of the processing device 600. Then, processor 610 terminates the process of standard device 900. The information of standard image length D1 is used, at a later-mentioned step S180, for judgment of the distance of gap g of spark plug 100.

At a step S160, independently of the determination (S100~S150) of standard image length D1, the spark plug 100 (FIG. 1) is assembled. The spark plug may be assembled in any known method. At this stage, the gasket 90 is not yet attached to the outer metal member 50. At a step S165, the distance of gap g is adjusted. For example, the distance of gap g is adjusted by adjusting the bend of ground electrode 30. At a step S170, the spark plug 100 is set in the jig 800 of the image capturing system 700 (FIG. 3). The step S170 is performed after the end of the process of determining the standard image length D1. The position of light source 710 with respect to digital camera 720 and the position and orientation of jig 800 with respect to digital camera 720 are so set that the position of light source 710 and the position and orientation of jig 80 are substantially identical, respectively, to the position of light source 710 and the position and orientation of jig 800 in the state in which the most recent (hence proper) standard image data is obtained by the process of S100~S150. The position of light source 710 may be held unchanged from the state in which the most recent (hence proper) standard image data is obtained. Furthermore, the position and orientation of jig 800 may be held unchanged from the state in which the most recent (hence proper) standard image data is obtained.

Figure 9:
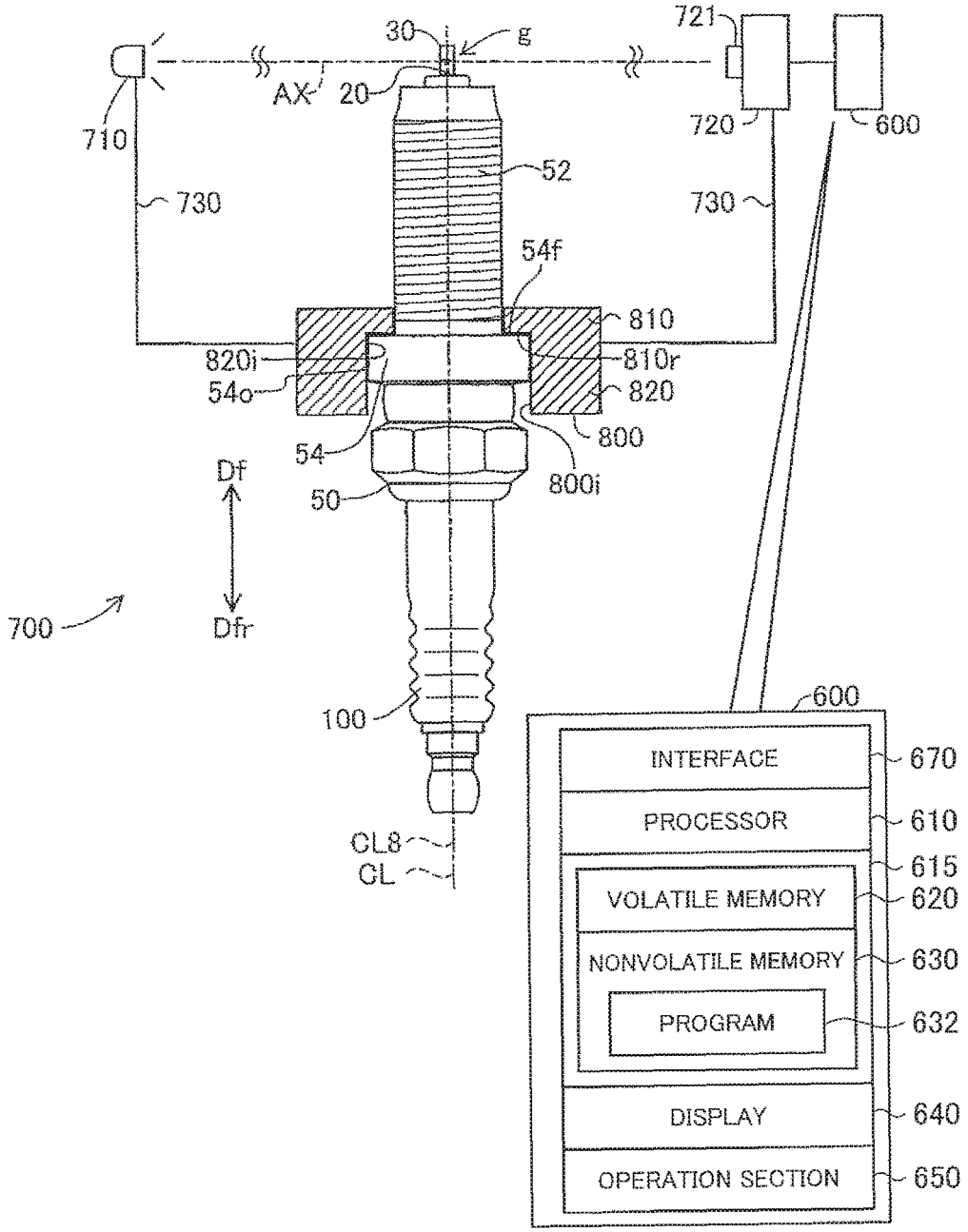
FIG. 9 is a view showing the spark plug set in the image capturing system.

FIG. 9 is a view showing the spark plug 100 set in the image capturing system 700. Like FIG. 3, FIG. 9 shows a section including the axial line CL8 of jig 800 and the appearance of spark plug 100 set in the jig 800. As shown in FIG. 9, the standard device 900 is removed from jig 800, and the spark plug 100 is fit in the through hole 800*i* of jig 800 in place of standard device 900. The middle trunk portion 54 of outer metal member 50 of spark plug 100 is fit in the second portion 820 of jig 800. The rear part of forward trunk portion 52 of outer metal member 50 of spark plug 100 on the rearward direction Dfr side is fit in the first portion 810 of jig 800. In the through hole 800*i*, the spark plug 100 is disposed at the position at which the axial line CL of spark plug 100 substantially coincides with the axial line CL8 of jig 800. For example, the outside circumferential surface 54*o* of middle trunk portion 54 of spark plug 100 is fit in the inside circumferential surface 820*i* of second portion 820 of jig 800, and the axial lines C1 and CL8 are held substantially coincident with each other by the contact between the outside circumferential surface 54*o* of spark plug 100 and the inside circumferential surface 820*i* of jig 800.

In the through hole 800*i* of jig 800, the spark plug 100 is disposed at the position at which the seat surface 54*f* of spark plug 100 abuts on the shoulder surface or support portion 810*r* in the through hole 800*i* of jig 800. In this way, the shoulder surface or support portion 810*r* of jig 100 abuts on and supports the seat surface 54*f* of spark plug 100. This abutment functions to set the spark plug 100 in jig 800 correctly and to restrain deviation in the position and orientation of the spark plug 100 with respect to jig 800.

When the spark plug 100 is set in jig 800 in this way, the gap g of spark plug 100 is positioned in the vicinity of the optical axis AX. The orientation of spark plug 100 in the circumferential direction around the center axis CL8 or CL is adjusted so that the direction in which the ground electrode 30 extends (the inward radial direction from the outer circumference toward the center) is set substantially perpendicular to the optical axis AX.

At a step S173 of FIG. 2, the operator or user inputs a command to start the process of the spark plug 100 by operating the operation section 650 of the processing device 600 (FIG. 9). In response to this command, the processor 610 starts the process according to the program 632. Specifically, at step S173, the processor 610 takes a picture of the spark plug 100 in digital form by controlling the digital camera 720. Then, the processor 610 obtains image date produced by the shooting, from the digital camera 720. Under the control of processor 610, the digital camera 720 produces image data (referred to as gap image data) representing a gap image which is image including an image of the gap g of spark plug 100. In this practical example, the gap image data is in the form of bitmap data like the standard image data.

Figure 10A:
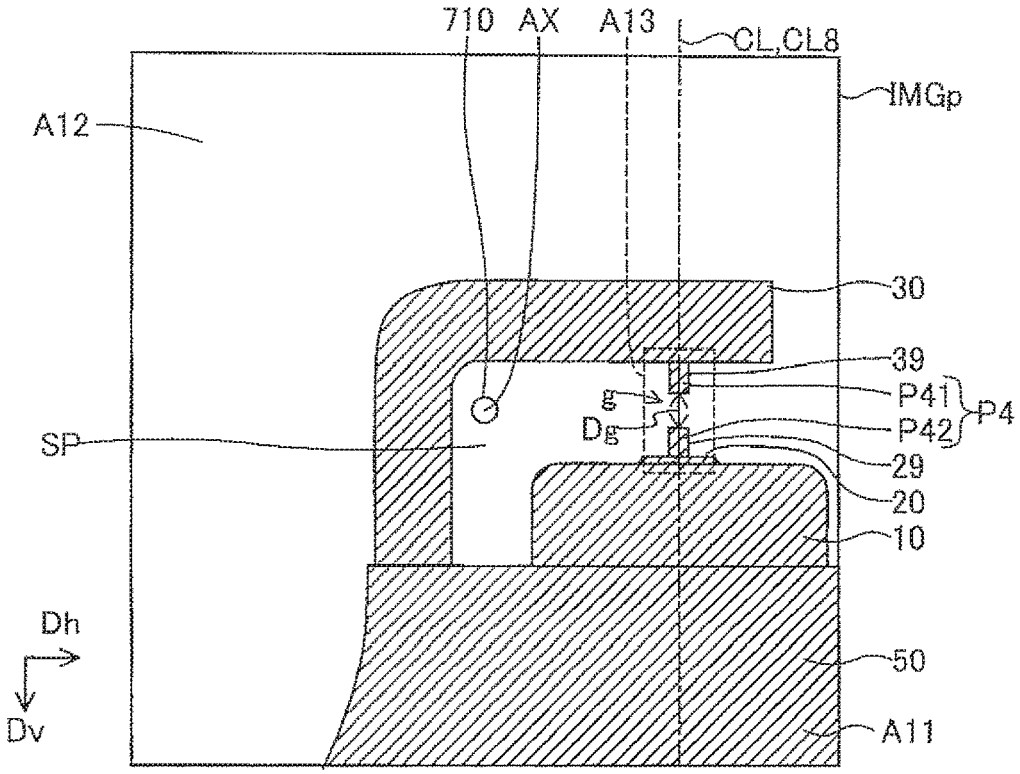
FIG. 10A is a view showing an example of gap image in this practical example and FIG. 10B is a view showing a histogram showing an example of a distribution of luminance values Y.

FIG. 10A shows an example of a gap image. This gap image IMGp represents a portion including the gap g of spark plug 100. As shown in FIG. 9, the spark plug 100 is positioned between the light source 710 and digital camera 720. Therefore, in the gap image IMGp, a region A11 representing spark plug 100 is relatively dark and a region A12 representing the background including the gap g is relatively bright. Furthermore, as shown in FIG. 10A, the light source 710 (and hence the optical axis AX) is located in a space SP (space wider than gap g) between the bent portion of ground electrode 30 and the insulating member 10. In this practical example, the wide slit segment 957 of standard device 900 is provided at the position corresponding to the space SP of spark plug 100. The light quantity of light source 710 is set at the value of the light quantity in the state in which the most recent (hence proper) standard image data have been obtained by the process of S100~S150 of FIG. 2. It is possible to hold the light quantity of light source 710 unchanged from the state in which the proper standard image data have been obtained.

At steps S175 and S177, the processor 610 analyzes the gap image data and thereby determines a gap image length Dg which is a length in the gap image IMGp (FIG. 10A) and which corresponds to the length or distance of gap g. The gap image length Dg can be determined by various methods. In this practical example, at S175, the processor 610 first divides the gap image IMGp into a plug region A11 representing the spark plug 100 and a background region A12 representing the background including the gap g. Specifically, the processor 610 divides the gap image IMGp into the plug region A11 and background region A12 by analyzing a histogram of the luminance in the same manner as the analysis of the standard image IMGs shown in FIGS. 6A and 6B.

Figure 10B:
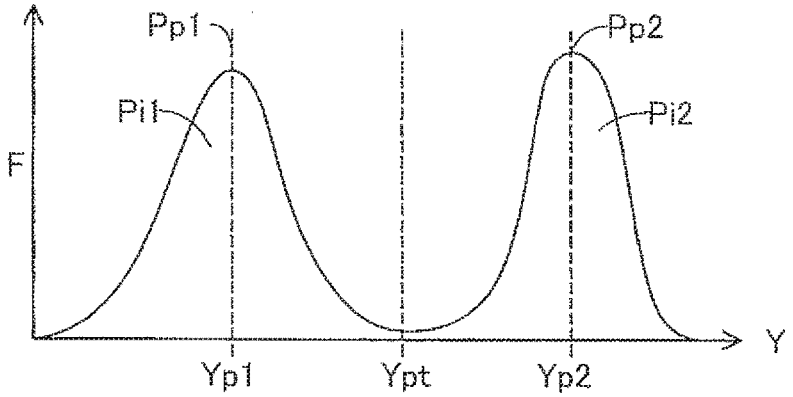

FIG. 10B is a histogram showing the distribution of values of luminance Y, as an example. The horizontal axis represents the luminance Y and the vertical axis represents the frequency F of pixels. As shown in FIG. 10B, the histogram of luminance Y shows a relatively dark first peak Pi1 representing the plug region A11 and a relatively bright second peak Pi2 representing the background region A12. In FIG. 10B, Ypt is a threshold. The threshold Ypt can be determined in the same manner as the threshold Yst shown in FIG. 6B. In this practical example, the threshold Ypt is set equal to an average of a luminance value Yp1 of the summit Pp1 of first peak Pi1 and a luminance value Yp2 of the summit Pp2 of second peak Pi2. The pixels having luminance values lower than the threshold Ypt are classified into the pixels of first peak Pi1, that is the pixels of plug region A11. The pixels having luminance values higher than or equal to the threshold Ypt are classified into the pixels of second peak Pi2, that is the pixels of background region A12.

At a step S177 (FIG. 2), the gap image length Dg is determined by using a portion corresponding to the gap g in at least one of the regions A11 and A12 (FIG. 10A). The gap image length Dg can be determined by various methods. In this practical example, processor 610 determines a gap image portion P4 representing a portion forming the gap g in the plug region A11. The gap image portion P4 is made up of two portions P41 and P42 spaced from each other. The first portion P41 represents a part of ground electrode 30, and the second portion P42 represents a part of center electrode 20. The gap image portion P4 may be determined by various methods. For example, at S170 of FIG. 2, the spark plug 100 (FIG. 9) is disposed at the position at which the gap g is located at a predetermined position in the gap image IMGp. Therefore, processor 610 can employ, as the gap image portion P4, a portion inside a predetermined region or range A13 in gap image IMGp. In this practical example, in the gap image IMGp, the spark plug 100, that is axial line CL of spark plug 100 is orientated in a predetermined direction. Specifically, the axial line CL is substantially parallel to the vertical direction Dv.

Processor 610 determines the gap image length Dg by using the demarcated gap image portion P4. The gap image length Dg may be determined by various ways. For example, the shortest distance between the two portions P41 and P42 can be employed as the gap image length Dg. The gap image length Dg is expressed by the same unit as the standard image length D1 of FIG. 6A (for example, Dg and D1 are both expressed by the number of pixels).

As mentioned above, the setting of the position of light source 710 with respect to digital camera 720, the orientation and position of jig 800 with respect to digital camera 720 and the light quantity of light source 710 used at the time of capturing an image picture of spark plug 100 is substantially equal to the setting of these conditions used when the proper standard image data have been obtained at S100~S150 of FIG. 2. Accordingly, processor 620 can obtain proper gap image data at S173 and determine the proper gap image length Dg.

At a step S180 of FIG. 2, by using the standard image length D1 and the gap image length Dg, the processor 610 determines whether the actual distance of gap g of spark plug 100 is within a predetermined allowable range or not. The judgment of S180 can be performed in various ways. For example, processor 610 calculates the actual distance of gap g by multiplying the gap image length Dg by a ratio of the actual width Da of standard slit segment 953 of slit 950 of standard device 900 to the standard image length D1 (the width Da is preliminarily determined. The unit of width Da is mm, for example). Then, processor 610 examines whether the thus-calculated actual distance of gap g is within the predetermined allowable range or not. Instead of this method, processor 610 may be configured to calculate upper and lower limits of an allowable range of gap image length Dg by multiplying each of the upper and lower limits of the allowable range of the actual distance of gap g by a ratio of the standard image length D1 to the actual width Da of standard slit segment 953, and to examine whether the gap image length Dg is within the allowable range of gap image length Dg. When the gap image length Dg is within the allowable range of gap image length Dg, the actual distance of gap g is within the allowable range of the actual distance of gap g.

When the actual distance of gap g is not within the allowable range (S180: No), then the processor 610 proceeds to a step S185. At S185, processor 610 outputs result information representing the result of the judgment of S180 to the device for receiving the result information, and then terminates the process of spark plug 100. For example, processor 610 delivers the result information to the display section 640 and causes the display section 640 to display the result information. The user can know the result of the judgment by watching the display. Moreover, processor 610 may be configured to output the result information to the storage device 615 and to store the result information in the storage device 615 (in the nonvolatile memory 630, for example). A data processing device (such as the processing device 600) and the user can recognize the result of the judgment by referring to the result information stored in the storage device 615. Then, the process returns to the step 165, and the distance of gap g of spark plug 100 is adjusted again. Then, steps S170~S180 are performed.

When the actual distance of gap g is within the allowable range (S180: Yes), the processor 610 outputs, at a step S190, the result information representing the result of the judgment of S180 to the device for receiving the result information, and then terminates the process of spark plug 100. The operation of S190 is the same as the operation of S185. Then, at a step S195, the gasket 90 is attached to the outer metal member 50 of spark plug 100. In this way, the spark plug 100 is completed and the process of FIG. 2 ends. When the gasket 90 is omitted from spark plug 100, the step S195 is omitted.

The standard image length D1 determined by the process of S100~S150 may be used in common for production of a plurality of spark plugs 100.

As explained above, the production system of this practical example is arranged to produce the standard image data representing the standard image IMGs (FIG. 6A), at S105 of FIG. 2, by capturing a (digital) picture of the standard device 900 with an image capturing device which is the digital camera 720 in this practical example. The standard image IMGs is an image including an image of the slit 950 of the standard device 900. As explained with reference to FIG. 4C, the standard device 900 includes the slit forming section 940 forming or defining the slit 950 which includes the standard slit segment 953 having the predetermined width Da. At S110 and S145 of FIG. 2, the production system analyzes the standard image data and thereby determine the width D1 of the standard slit segment 953 (953, 953*c*, 953*d*) in or on the standard image. At S173 of FIG. 2, the production system produces the gap image data representing the gap image IMGp (FIG. 10A) by capturing a (digital) picture of the spark plug 100, with the same digital camera 720. The gap image IMGp is an image including an image of the discharge gap. At S175 and S177 of FIG. 2, the production system analyzes the gap image data and thereby determines the distance Dg of the discharge gap g in or on the gap image IMGp. At S180 of FIG. 2, the production system determines whether the actual distance of the discharge gap g is within the predetermined allowable range or not, by using the distance Dg of the discharge gap g determined in the gap image IMGp and the width D1 of the standard slit segment 953 determined in the standard image IMGs.

In this way, the distance Dg of the discharge gap g determined in the gap image IMGp obtained by taking an image picture of the spark plug 100 and the width D1 of the standard slit segment 953 determined in the standard image IMGs obtained by taking an image picture of the standard device 900 are used for judging whether the actual distance of gap g is within the predetermined allowable range or not. Therefore, it is possible to improve the accuracy of the judgment as to whether the actual distance of gap g is within the predetermined allowable range. With the improved accuracy in the judgment, it is possible to restrain a decrease of the production yield of the spark plug 100 and at the same time to achieve smaller tolerance of the gap g.

As shown in FIG. 1, the clearance between the ground electrode 30 and center electrode 20 of spark plug 100 is not closed but open at one end on one side. As explained with reference to FIG. 4C, the portion 944 defining the end 951 of slit 950 in the slit forming section 940 is open. With this configuration, it is possible to make the shape of the slit forming section 940 of standard device 900 closer to the shape of the portion forming the gap g in spark plug 100. Consequently, it is possible to reduce the difference in the conditions of capturing the digital images between the standard image IMGs and gap image IMGp, and thereby to improve the accuracy in the judgment using the width D1 in standard image IMGs and the distance Dg in gap image IMGp (to determine whether the actual distance of gap g is within the allowable range).

As shown in FIG. 1, the distance between ground electrode 30 and center electrode 20 of spark plug 100 is smallest at the gap g. Behind the gap g on the side closer to the end portion 33 of ground electrode 30, there is formed, between the ground electrode 30 and insulating member 10, a space greater than the gap g. As explained with reference to FIG. 4C, the slit forming section 940 includes the portion 947 defining the wide slit segment 957 which has the width Dc greater than the width Da of standard slit segment 953 and which is located so that the standard slit segment 957 is located between the end 951 and the wide slit segment 957. With this configuration, it is possible to make the shape of the slit forming section 940 closer to the shape of the portion of spark plug 100 defining gap g. As a result, it is possible to reduce the difference in the conditions of capturing the digital images between the standard image IMGs and gap image IMGp, and thereby to improve the accuracy in the judgment using the width D1 in standard image IMGs and the distance Dg in gap image IMGp (to determine whether the actual distance of gap g is within the allowable range).

Moreover, as explained with reference to FIG. 4C, the portion 949 defining the end 959 of the slit 950 on the side opposite to the end 951 is closed, and this closed end 959 is defined by the straight edge 948 extending in the direction (slit widthwise direction) perpendicular to the slit longitudinal direction which is the direction in which the standard slit segment 953 extends. As mentioned before, by using this straight edge 948 as the basis or reference or standard, it is possible to calculate the parameter (D2, D4 for example) used for examining whether the orientation of standard device 900 in the circumferential direction is proper, at the time of image capturing. Accordingly, it is possible to improve the accuracy in calculating the parameters, and hence to improve the accuracy in judging whether the orientation of standard device 900 in the circumferential direction is proper or not. Consequently, it is possible to improve the accuracy in judgement as to whether the actual distance of gap g is within the allowable range or not.

As explained with reference to FIG. 4C, the edge or side 941 of slit forming section 940 on the first direction Dx side is in the form of a straight edge extending in the direction perpendicular to the slit longitudinal direction of standard slit segment 953. As mentioned before, it is possible to calculate the parameter (length D4, for example) used for judgment as to whether the orientation of standard device 900 in the circumferential direction is proper or not, by using, as the basis or reference, this straight edge 941. Accordingly, it is possible to improve the accuracy in calculating the parameters, and hence to improve the accuracy in judging whether the orientation of standard device 900 in the circumferential direction is proper or not. Consequently, it is possible to improve the accuracy in judgement as to whether the actual distance of gap g is within the allowable range or not.

As explained with reference to FIG. 4C, the slit forming section 940 includes the second portion 947 defining part of the sides of a regular polygon (a square, in this example). The second portion 947 of this practical example defines the wholes of the three sides of the square, and the remaining one side having a connection portion or mouth at which the standard slit segment 953 is connected with the wide slit segment 957. As mentioned before, the center of the regular polygon can be used for alignment or positioning the light source 710, so that it is possible to restrain deviation of the position or misregistration of light source 710. Consequently, it is possible to improve the accuracy in judgement as to whether the actual distance of gap g is within the allowable range or not.

As explained with reference to FIG. 4C, the position of the center of the regular polygon in the direction (slit widthwise direction) perpendicular to the slit longitudinal direction of standard slit segment 953 is located within the range Rs determined by the width of standard slit segment 953. Therefore, in the standard image IMGs (FIG. 6), the two edges P31*x* and P32*x* of standard slit segment 953 are disposed so that the difference in the positions with respect to the light source 710 is reduced, and hence the difference in influence of the diffraction of light is reduced between the edges P31*x* and P32*x* of standard slit segment 953. Consequently, it is possible to improve the accuracy in judgement as to whether the actual distance of gap g is within the allowable range or not. In the example of FIG. 4C, the center of the regular polygon is located on a center line of the standard slit segment 953, and the slit 950 including the standard slit segment 953 and wide slit segment 957 is symmetrical in the manner of bilateral symmetry with respect to the center line of the standard slit segment 953 as shown in FIG. 4C.

As explained with reference to FIG. 3, the position of jig 800 relative to digital camera 720 is preliminarily determined. At the time of image capturing of standard device 900, the shoulder surface 920*f* of second portion 920 of standard device 900 abuts against the support portion 810*r* of jig 800 held at the predetermined position. This abutment prevents undesired shift of standard device 900 with respect to digital camera 720, and makes it possible to determine the proper standard image length D1. Consequently, it is possible to improve the accuracy in judgement as to whether the actual distance of gap g is within the allowable range or not.

As explained with reference to S170 and S173 and FIG. 9, the operation of capturing image of spark plug 100 is performed in the state in which the shoulder surface 54*f* of outer metal member 50 abuts against the support portion 810*r* of jig 800 held at the predetermined position. This abutment prevents undesired shift of spark plug 100 with respect to digital camera 720, and makes it possible to determine the proper gap image length Dg. Consequently, it is possible to improve the accuracy in judgement as to whether the actual distance of gap g is within the allowable range or not.

In this practical example, the orientation of jig 800 can be adjusted at S125 of FIG. 2, in accordance with the condition 5 which is a predetermined condition to obtain the proper standard image IMGs. With the adjustment of the orientation of jig 800 at S125 in the predetermined direction, it is possible to restrain deviation in the orientation of standard device 900 with respect to digital camera 720 and hence to determine the proper standard image length D1. Consequently, it is possible to improve the accuracy in judgement as to whether the actual distance of gap g is within the allowable range or not.

Among the parameters including the position of jig 800, the orientation of jig 800, the position of light source 710, and the light quantity of light source 710, at least one of the parameters may be different at the time of image capturing of spark plug 100, from the time of capturing the image of the standard device 900. However, when the conditions differ widely between the image capturing operation of standard device 900 and the image capturing operation of spark plug 100, then it may be difficult to obtain the proper gap image IMGp (and to determine the proper gap image length Dg). Therefore, it is preferable to reduce the difference in each parameter (the difference in the position of jig 800, for example) so as to obtain the proper gap image length Dg. Moreover, it is optional to adjust at least one of these parameters at the time of capturing the image of spark plug 100. For example, the position of light source 710 may be adjusted at the time of capturing the image of spark plug 100. It is possible to adjust one or more of these parameters at the time of capturing the image of spark plug 100 in the same method of adjusting the parameters at the time of capturing the image of standard device 900.

B. Different Modes of the Slit Forming Section

FIGS. 11A~11D show different forms of the slit forming section 940. Like FIG. 4C, FIGS. 11A~11*d* show parts of slit forming sections 940*a*~940*d*.

Figure 11A:
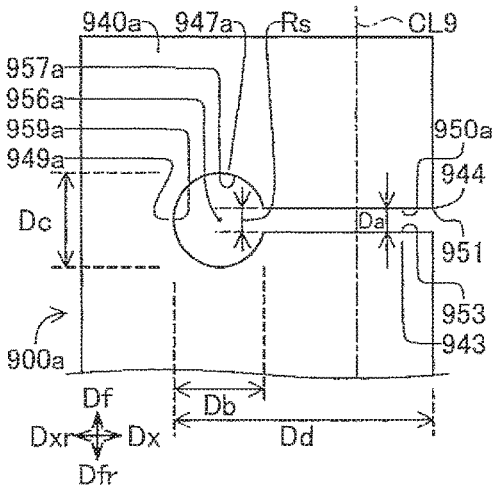
FIGS. 11A, 11B, 11C and 11D are views showing different examples of the slit forming section 940.

The slit forming section 940*a* shown in FIG. 11A defines a slit 950*a* which includes a circular wide slit segment 957*a* instead of the square wide slit segment 957 shown in FIG. 4C. The slit forming section 940*a* includes the first portion 943 defining the standard slit segment 953 and a second portion 947*a* defining the wide slit segment 957*a*. The second portion 947*a* forms a circular arc subtending an angle at the center of the circle that is greater than 180 degrees. Specifically, the circular arc is in the form of a circle except for a connection portion at which the standard slit segment 953 is connected with the wide slit segment 957*a*. A portion 949*a* of the slit portion section 940*a* defining a second slit end 959*a* of the slit 950*a* on the second direction Dxr side is closed. Except for the second portion 947*a*, the slit forming section 940*a* is the same as the slit forming section 940 of FIG. 4C. (Repetitive explanation is omitted by assigning the same reference numerals to the same elements.) In the case of slit forming section 940*a*, it is possible to achieve advantages as in the case of slit forming section 940. For example, by the use of the center 956*a* of circular wide slit segment 957*a*, it is possible to adjust the position of light source 710 easily. The circular arc of wide slit segment 957*a* is in the form of an arc of a circle, and the center 956*a* may be set at the center of the circle. The width Dc is a greatest width of the wide slit segment 957*a* in the direction (slit widthwise direction) perpendicular to the slit longitudinal direction of standard slit segment 953. By using the sizes in the gap image (not shown) corresponding to the parameters Da, Db, Dc and Dd, it is possible to adjust the orientation of standard device 900*a* including the slit forming section 940*a*. In the example shown in FIG. 11A, the slit 950*a* is symmetrical in the manner of bilateral symmetry with respect to the longitudinal center line of standard slit segment 953.

Figure 11B:
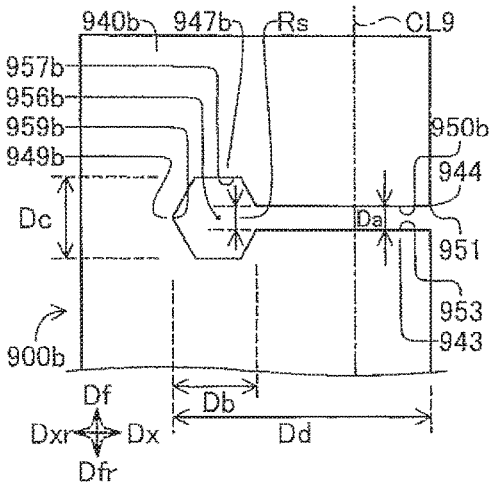

The slit forming section 940*b* shown in FIG. 11B defines a slit 950*b* which includes a polygonal wide slit segment 957*b* instead of the square wide slit segment 957 shown in FIG. 4C. The slit forming section 940*b* includes the first portion 943 defining the standard slit segment 953 and a second portion 947*b* defining the wide slit segment 957*b*. The second portion 947*b* forms a regular polygon (a regular hexagon in this example) connected with one end of standard slit segment 953. In this example, the second portion 947*b* defines four sides of the hexagon and parts of two adjacent side. The remaining parts of the two adjacent sides are arranged to form an apex, but removed to form a connection portion with the standard slit segment 953. A portion 949*b* of the slit forming section 940*b* defining a second slit end 959*b* of the slit 950*b* on the second direction Dxr side is closed. Except for the second portion 947*b*, the slit forming section 940*b* is the same as the slit forming section 940 of FIG. 4C. (Repetitive explanation is omitted by assigning the same reference numerals to the same elements.) In the case of slit forming section 940*b*, it is possible to achieve the advantages as in the case of slit forming section 940. For example, by the use of the center 956*b* of polygonal wide slit segment 957*b*, it is possible to adjust the position of light source 710 easily. The center 956*b* may be set at the center of the regular polygon (hexagon). The width Dc is a greatest width of the wide slit segment 957*b* in the direction (slit widthwise direction) perpendicular to the slit longitudinal direction which is the direction in which the standard slit segment 953 extends. By using the sizes in the gap image (not shown) corresponding to the parameters Da, Db, Dc and Dd, it is possible to adjust the orientation of standard device 900*b* including the slit forming section 940*b*. In the example shown in FIG. 11B, the slit 950*b* is symmetrical in the manner of bilateral symmetry with respect to the longitudinal center line of standard slit segment 953.

Figure 11C:
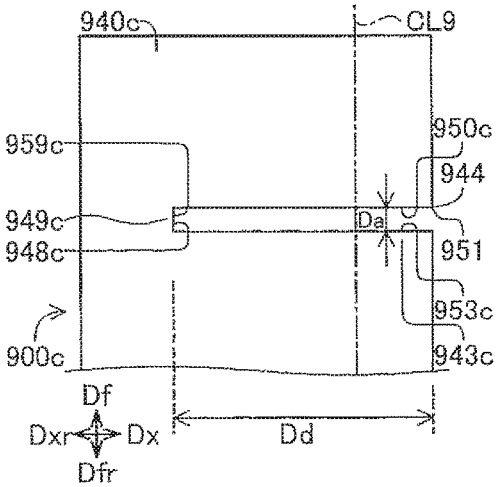

The slit forming section 940*c* shown in FIG. 11C defines a slit 950*c* in which the wide slit segment 957 shown in FIG. 4C is omitted, and instead a standard slit segment 953*c* is extended longer. The slit forming section 940*c* includes a first portion 943*c* defining the standard slit segment 953*c*. The standard slit segment 953*c* extends longer in the second direction Dxr as compared to the standard slit segment 953 of FIG. 4C. In the case of slit forming section 940*c*, it is possible to achieve various advantages. For example, by using the length Dd of slit 950*c* in the longitudinal direction of the standard slit segment 953*c* (perpendicular to the axial line CL9, in this example), it is possible to adjust the orientation of standard device 900*c* including the slit forming section 940*c*. A portion 949*c* of the slit forming section 940*c* defining a second slit end 959*c* of the slit 950*c* on the second direction Dxr side is closed. The second slid end 959*c* is defined by a straight edge 948*c* extending in a direction (slit widthwise direction) perpendicular to the slit longitudinal direction of standard slit segment 953*c*. By using, as the base or reference, the edge 948*c*, it is possible to calculate a length corresponding to the length Dd in the gap image (length D4 in FIG. 6A, for example). Thereby, it is possible to improve the accuracy in calculation of the parameters, and hence to improve the accuracy in judgment as to whether the orientation of standard device 900*c* in the circumferential direction is proper or not. Consequently, it is possible to improve the accuracy in judgement as to whether the actual distance of gap g is within the allowable range or not. In the example shown in FIG. 11C, the slit 950*c* is symmetrical in the manner of bilateral symmetry with respect to the longitudinal center line of standard slit segment 953*c*.

Figure 11D:
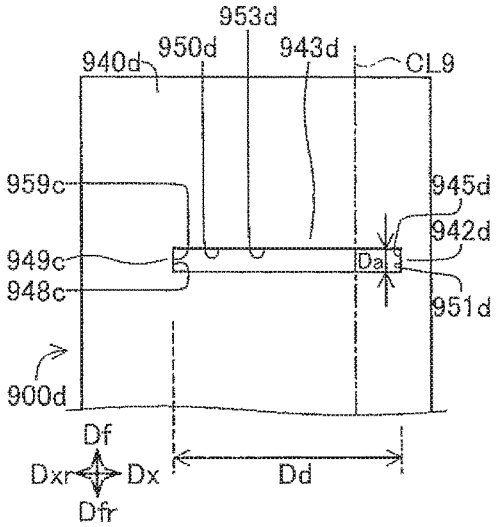

The slit forming section 940*d* shown in FIG. 11D defines a slit 950*d* having first and second slit ends 951*d* and 959*c* which are both closed. The slit 950*d* is formed by closing the first slit end 951 of slit 950*c* shown in FIG. 11C. The slit forming section 940*d* of FIG. 11D includes a first portion 943*d* defining a standard slit segment 953*d* which is a rectangular slit having a substantially long rectangular shape. The standard slit segment 953*d* is formed inside, and enclosed by, the slit forming section 940*d*. In the case of the slit forming section 940*d*, it is possible to achieve various advantages. For example, by using the length Dd of slit 950*d* in the longitudinal direction of the standard slit segment 953*d* (perpendicular to the axial line CL9, in this example), it is possible to adjust the orientation of standard device 900*c* including the slit forming section 940*d*. In the example shown in FIG. 11D, the slit 950*d* is symmetrical in the manner of bilateral symmetry with respect to the longitudinal center line of standard slit segment 953*d*.

The slit forming section 940*d* of FIG. 11D includes the portion 949*c* defining the second slid end 959*c* on the second direction Dxr side, and this portion 949*c* is closed as in the slit 950*c* of FIG. 11C. The second slid end 959*c* is defined by the straight edge 948*c* extending in the direction perpendicular to the longitudinal direction of standard slit segment 953*c* as in the slit 950*c* of FIG. 11C. The slit forming section 940*d* further includes a portion 942*d* defining the first slit end 951*d* on the first direction Dx side. This portion 942*d* is also closed, and formed to define a straight edge 945*d* extending straight in the direction (slit widthwise direction) perpendicular to the (slit) longitudinal direction of the standard slit segment 953*d*. By using, as the base or reference, the edge 948*c* and edge 945*d*, it is possible to calculate a length corresponding to the length Dd in the gap image (length D4 in FIG. 6A, for example). For example, the length corresponding to length Dd is set equal to the shortest distance between the edges 948*c* and 945*d* in the gap image IMGs. Thereby, it is possible to improve the accuracy in calculation of the parameters, and hence to improve the accuracy in judgment as to whether the orientation of standard device 900*c* in the circumferential direction is proper or not. Consequently, it is possible to improve the accuracy in judgement as to whether the actual distance of gap g is within the allowable range or not.

C. Variation Examples (1) The method of determining the standard image length D1 by analyzing the standard image data is not limited to the method explained with reference to S110 and S145 of FIG. 2, and the standard image length D1 can be determined by various other methods. For example, the standard image length D1 can be determined by using a portion corresponding to the standard image length D1 in the background region A2 in the standard image IMGs (FIG. 6), without using the standard device region A1. Moreover, by using at least one of standard device region A1 and background region A2, it is possible to determine the portion corresponding to standard image length D1 in standard image IMGs by pattern matching using the shape of standard slit segment 953.

(2) The method of determining the gap image length Dg by analyzing the gap image data is not limited to the method explained with reference to S175 and S177 of FIG. 2, and the gap image length Dg can be determined by various other methods. For example, the gap image length Dg can be determined by using a portion corresponding to the gap g in the background region A12 in the gap image IMGp (FIG. 10A), without using the plug region A11. Moreover, by using at least one of plug region A11 and background region A12, it is possible to determine the portion corresponding to gap image length Dg in gap image IMGp by pattern matching using the shape of gap g.

(3) The construction of the slit forming section (and the shape of the slit) is not limited to the constructions shown in FIG. 4C and FIGS. 11A~11D, and it is optional to employ various other constructions. For example, the closed slit ends 959, 959*a*, 959*b* and 959*c* of slits 950, 950*a*, 950*b*, 950*c* and 950*d* may be inclined or oblique with respect to the (slit) longitudinal direction of standard slit segments 953, 953*c* and 953*d*. The center 956*a* of circular segment 957*a* (FIG. 11A) may be located outside the range Rs of width of standard slit segment 953. The center 956 or 956*b* of polygonal segment 957 or 957*b* (FIG. 4C, FIG. 11C) may be located outside the range Rs of width of standard slit segment 953. Instead of the symmetrical slit, it is optional to employ a slit having a shape which is not symmetrical with respect to the longitudinal center line of the slit.

Moreover, the wide slit segment may be in various shapes having a greatest width greater than the width of the standard slit segment as measure in the direction (slit widthwise diredtion) perpendicular to the standard slit segment. For example, the wide slit segment may be in the form of a polygon which is not regular (a trapezoid, for example). The wide slit segment is connected with the standard slit segment at a connection portion or mouth at which the circumference (circle or polygon) of the wide slit segment is cut out and the second end of the standard slit segment is open into the wide slit segment.

(4) The construction of the standard device is not limited to the construction shown in FIG. 4A, etc., and it is optional to employ various other constructions. For example, the portions 910, 920 and 930 may be in the form of a column having a polygonal cross section (a quadrilateral or square, for example), instead of the cylindrical column. Moreover, it is possible to omit the third portion 930. In either case, the standard device includes the slit forming section, the second portion and the first portion formed between the slit forming section and the second portion, and the slit forming section, the first portion and the second portion are arranged in a predetermined longitudinal direction. Preferably, the second portion projects in a predetermined direction (or a radial direction) perpendicular to the predetermined longitudinal direction of the standard device, like an outward flange, and includes a shoulder surface or an annular shoulder surface (such as the shoulder surface 920*f* of FIG. 4A) which faces toward the slit forming section and which is arranged to abut against a predetermines surface of the jig in order to determine the position of standard device relative to the jig.

(5) The construction of the jig is not limited to the construction shown in FIG. 5, etc. and it is optional to employ various other constructions. For example, it is possible to omit the second portion 820 and to employ the jig including only the first portion 810. In general, the jig may be in the form of various shapes having a hole receiving the forward trunk portion 52 of outer main metal member 50 (FIG. 1) and a support portion or support surface which supports the seat surface 54*f* of outer main metal member 50 by abutting on the seat surface 54*f*.

(6) The conditions for judging whether the position of the standard device is proper or not are not limited to the conditions explained with reference to S115 of FIG. 2, and it is possible to employ various other conditions instead of the above-mentioned conditions. Moreover, the conditions for judging whether the position of the light source is proper or not are not limited to the conditions explained with reference to S115 of FIG. 2, and it is possible to employ various other conditions instead of the above-mentioned conditions. For example, it is possible to omit any one or more of the conditions 1 to 5.

(7) The construction of the spark plug is not limited to the construction shown in FIG. 1, and it is possible to employ various other constructions. For example, it is possible to omit the gasket 90. Moreover, instead of the end surface of the center electrode on the forward Df side, it is possible to employ, as the discharge surface, a surface perpendicular to the axial line CL (that is, a side surface). The side surface of the center electrode is used as the discharge surface. In this case, the slit forming section of the standard device is so formed that, like the spark plug, a portion corresponding to the ground electrode confronts a surface of a portion corresponding to the center electrode perpendicular to the axial line CL9 and thereby forms a slit with the surface perpendicular to the axial line CL9. It is possible to omit the resistor 73. It is optional to provide a magnetic member between the center electrode and the terminal member 40 in the through hole 12 of insulating member 10.

(8) The processing device 600 shown in FIG. 3 and FIG. 9 may be a device other than the personal computer. (For example, the processing device 600 may be a digital camera or a smartphone.) Furthermore, the processing device may be a plurality of devices (computers, for example) which are connected through a communication network and which are configure to share roles of the processing function of judging whether the actual distance of gap g is within the allowable range or not, and to perform the processing function in a group.

In the preceding embodiments and examples, it is optional to replace a part of the construction implemented by the hardware by software, and conversely to replace part or all of the construction implemented by the software by hardware. For example, the process of S110 and S175 of FIG. 2 may be performed by a hardware circuit specifically designed for this process.

When part or whole of the function of the present invention is implemented by computer program, the program may be provided in the form of computer-readable storage medium (non-temporary storage medium, for example) having therein the program. The program can be used in the state in which the program is stored in the original storage medium or another storage medium (computer readable storage medium). The computer-readable storage medium may be a portable storage medium such as memory card and CD-ROM, or may be an internal storage device inside a computer such as various ROMs, or an external storage device such as a hard disc drive connected with a computer.

This application is based on a prior Japanese Patent Application No. 2017-193327 filed on Oct. 3, 2017. The entire contents of this Japanese Patent Application are hereby incorporated by reference.

Although the invention has been described above by reference to certain embodiments of the invention and variation examples, the embodiments and examples are examples to facilitate understanding of the invention, and the invention is not limited to the embodiments and examples described above. Modifications and variations are possible within the purview of the invention and various equivalents are within the scope of the invention.

Having described the invention, the following is claimed:

1. A spark plug production method of producing a spark plug which comprises an insulating member, a center electrode including a portion disposed at a forward end of the insulating member, a tubular outer metal member surrounding the insulating member, and a ground electrode connected with the outer metal member and arranged to confront the center electrode to form a discharge gap, the spark plug production method comprising:

producing standard image data representing a standard image by capturing an image of a standard device including a slit forming section forming a slit which includes a standard slit segment having a predetermined width, with an image capturing device, the standard image being an image including an image of the slit of the standard device;

determining a width of the standard slit segment of the slit in the standard image by analyzing the standard image data;

producing gap image data representing a gap image which is an image including an image of the discharge gap, by capturing an image of the spark plug with the image capturing device;

determining a distance of the discharge gap in the gap image, by analyzing the gap image data; and determining whether an actual distance of the discharge gap is within a predetermined allowable range or not, by using the distance of the discharge gap determined in the gap image and the width of the standard slit segment determined in the standard image.

2. The spark plug production method as claimed in claim 1, wherein the slit forming section includes a portion defining a first slit end which is one end of the slit and which is open.

3. The spark plug production method as claimed in claim 2, wherein the slit forming section includes a portion defining a wide slit segment which has a width greater than the width of the standard slit segment and which is located so that the standard slit segment is located between the first slit end and the wide slit segment.

4. The spark plug production method as claimed in claim 2, wherein the slit forming section includes a portion defining a second slit end which is closed and defined by a straight edge extending straight in a direction perpendicular to a direction in which the standard slit segment extends.

5. The spark plug production method as claimed in claim 3, wherein the slit forming section includes a portion defining a second slit end which is closed and defined by a straight edge extending straight in a direction perpendicular to a direction in which the standard slit segment extends.

6. The spark plug production method as claimed in claim 1, wherein the slit forming section includes a portion defining one of a circular arc and a part of a regular polygon, and a position of a center of one of the circular arc and the regular polygon in a direction perpendicular to a direction in which the standard slit segment extends is located in a range of the width of the standard slit segment.

7. The spark plug production method as claimed in claim 1, wherein the standard device includes first and second portions arranged in a predetermined direction so that the first portion is located between the slit forming section and the second portion, the second portion projects outwards beyond the first portion in a direction perpendicular to the predetermined direction, and the image of the standard device is captured with the image capturing device in a state in which a surface of the second portion of the standard device facing toward the slit forming section abuts on a predetermined portion of a jig set at a predetermined position relative to the image capturing device.

8. The spark plug production method as claimed in claim 7, wherein the image of the spark plug is captured with the image capturing device in a state in which a predetermined outside surface of the outer metal member facing toward the discharge gap abuts on the predetermined portion of the jig.

* * * * *